US009259954B2

(12) United States Patent
Tagawa et al.

(10) Patent No.: US 9,259,954 B2
(45) Date of Patent: Feb. 16, 2016

(54) SUPPORT FOR LITHOGRAPHIC PRINTING PLATE AND MANUFACTURING METHOD THEREFOR, AS WELL AS ORIGINAL LITHOGRAPHIC PRINTING PLATE

(71) Applicant: FUJIFILM Corporation, Tokyo (JP)

(72) Inventors: Yoshiharu Tagawa, Haibara-gun (JP); Shinya Kurokawa, Haibara-gun (JP); Atsushi Matsuura, Haibara-gun (JP); Yuya Miyagawa, Haibara-gun (JP); Hirokazu Sawada, Haibara-gun (JP); Atsuo Nishino, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/603,600

(22) Filed: Jan. 23, 2015

(65) Prior Publication Data

US 2015/0135979 A1 May 21, 2015

Related U.S. Application Data

(63) Continuation of application No. PCT/JP2013/070348, filed on Jul. 26, 2013.

(30) Foreign Application Priority Data

Jul. 27, 2012 (JP) ..... 2012-167777
Sep. 25, 2012 (JP) ..... 2012-210628
Mar. 15, 2013 (JP) ..... 2013-054293

(51) Int. Cl.
*B41N 1/08* (2006.01)
*B41N 1/14* (2006.01)

(Continued)

(52) U.S. Cl.
CPC *B41N 1/14* (2013.01); *B41N 3/034* (2013.01); *C25D 11/005* (2013.01); *C25D 11/08* (2013.01);

(Continued)

(58) Field of Classification Search
CPC ..... B41N 1/083; B41N 3/034; C25D 11/04; C25D 11/08; C25D 11/12; C25D 11/16; B41C 2210/08; G03F 7/09; C25F 3/04
See application file for complete search history.

(56) References Cited

U.S. PATENT DOCUMENTS

2011/0265673 A1* 11/2011 Tagawa et al. ..... 101/453
2012/0298001 A1 11/2012 Kurokawa et al.

FOREIGN PATENT DOCUMENTS

EP 2 353 882 A1 8/2011
JP 2011-173413 A 9/2011

(Continued)

OTHER PUBLICATIONS

International Search Report of PCT/JP2013/070348 dated Oct. 8, 2013., 1 page in English.

(Continued)

*Primary Examiner* — Blake A Tankersley
(74) *Attorney, Agent, or Firm* — Sughrue Mion, PLLC

(57) ABSTRACT

A lithographic printing plate support of the invention includes an aluminum plate and an anodized aluminum film which has micropores extending from a surface of the anodized film opposite from the aluminum plate in a depth direction of the anodized film; the micropores each have a large-diameter portion extending from the anodized film surface to an average depth (depth A) of 75 to 120 nm and a small-diameter portion which communicates with the bottom of the large-diameter portion; the average diameter of the large-diameter portion at the anodized film surface is at least 10 nm but less than 30 nm; a ratio of the depth A to the average diameter (depth A/average diameter) of the large-diameter portion is more than 4.0 but up to 12.0; and an average diameter of the small-diameter portion at the communication level is more than 0 but less than 10 nm.

18 Claims, 5 Drawing Sheets

(51) Int. Cl.

| | |
|---|---|
| ***B41N 3/03*** | (2006.01) |
| ***C25F 3/04*** | (2006.01) |
| ***C25D 11/08*** | (2006.01) |
| ***C25D 11/12*** | (2006.01) |
| ***C25D 11/16*** | (2006.01) |
| ***C25D 11/24*** | (2006.01) |
| ***C25D 11/00*** | (2006.01) |

(52) U.S. Cl.
CPC ..... *C25D 11/12* (2013.01); *C25D 11/16* (2013.01); *C25D 11/24* (2013.01); *C25F 3/04* (2013.01); *B41N 1/083* (2013.01)

(56) References Cited

FOREIGN PATENT DOCUMENTS

| | | | |
|---|---|---|---|
| JP | 2011-245844 | A | 12/2011 |
| JP | 2012-071435 | A | 4/2012 |

OTHER PUBLICATIONS

International Preliminary Report on Patentability and Written Opinion, mailed Feb. 5, 2015, issued in corresponding International Application No. PCT/JP2013/070348, 6 pages in English.

* cited by examiner

SUPPORT FOR LITHOGRAPHIC PRINTING PLATE AND MANUFACTURING METHOD THEREFOR, AS WELL AS ORIGINAL LITHOGRAPHIC PRINTING PLATE

CROSS REFERENCE TO RELATED APPLICATIONS

This application is a continuation application of International Application No. PCT/JP2013/070348 filed on Jul. 26, 2013, which claims priority under 35 U.S.C. 119(a) to Application No. 2012-167777 filed in Japan on Jul. 27, 2012, Application No. 2012-210628 filed in Japan on Sep. 25, 2012 and Application No. 2013-054293 filed in Japan on Mar. 15, 2013, all of which are hereby expressly incorporated by reference into the present application.

BACKGROUND OF THE INVENTION

The present invention relates to a lithographic printing plate support and a method of manufacturing a lithographic printing plate support, as well as a lithographic printing plate precursor.

Lithographic printing is a printing process that makes use of the inherent immiscibility of water and oil. Lithographic printing plates used in lithographic printing have formed on a surface thereof regions which are receptive to water and repel oil-based inks (referred to below as "non-image areas") and regions which repel water and are receptive to oil-based inks (referred to below as "image areas").

An aluminum support employed in a lithographic printing plate (referred to below simply as a "lithographic printing plate support") is used in such a way as to carry non-image areas on its surface. It must therefore have a number of conflicting properties, including, on the one hand, an excellent hydrophilicity and water retention and, on the other hand, an excellent adhesion to an image recording layer that is provided thereon. If the hydrophilicity of the support is too low, ink is likely to be attached to the non-image areas at the time of printing, causing a blanket cylinder to be scummed and thereby causing so-called scumming to be generated. In addition, if the water retention of the support is too low, clogging in a shadow area is generated unless the amount of fountain solution is increased at the time of printing. Thus, a so-called water allowance is narrowed.

Various studies have been made to obtain lithographic printing plate supports exhibiting good properties. For example, JP 2011-245844 A discloses a method of manufacturing a lithographic printing plate support which includes a first step for anodizing a roughened aluminum plate surface, followed by pore-widening treatment, and a subsequent step for reanodizing under such conditions that the diameter of micropores may be smaller than that in the anodized film formed in the first step. It is described that a lithographic printing plate obtained by using the lithographic printing plate support has a long press life and excellent on-press developability.

SUMMARY OF THE INVENTION

Meanwhile, in recent years, with the growth of performance requirements for the printing technique, there is a tough demand for higher performance in terms of various properties (particularly, the press life and the on-press developability) of a lithographic printing plate and a lithographic printing plate precursor obtained using a lithographic printing plate support. Generally, the press life has a trade-off relation with the on-press developability and it has been difficult to simultaneously achieve these properties.

The inventors of the invention have examined various properties of the lithographic printing plate and the lithographic printing plate precursor obtained using the lithographic printing plate support specifically described in JP 2011-245844 A and found that the on-press developability and the press life satisfy conventional, moderate performance requirements but do not satisfy current performance requirements, which is not necessarily satisfactory in practical use.

In view of the situation as described above, an object of the invention is to provide a lithographic printing plate support that has excellent scratch resistance, enables a lithographic printing plate formed therefrom to have a long press life and is capable of obtaining a lithographic printing plate precursor exhibiting excellent on-press developability. Another object of the invention is to provide a method of manufacturing such a lithographic printing plate support. Still another object of the invention is to provide a lithographic printing plate precursor.

The inventors of the invention have made an intensive study to achieve the objects and as a result found that the foregoing problems can be solved by controlling the micropore shape (particularly, shape of a large-diameter portion thereof) in the anodized film.

Specifically, the invention provides the following (1) to (9)

(1) A lithographic printing plate support, comprising an aluminum plate and an anodized film of aluminum which is formed on the aluminum plate and has micropores extending therein from a surface of the anodized film opposite from the aluminum plate in a depth direction of the anodized film, wherein each of the micropores has a large-diameter portion which extends from the surface of the anodized film to an average depth (depth A) of 75 to 120 nm and a small-diameter portion which communicates with a bottom of the large-diameter portion and extends to an average depth of 900 to 2,000 nm from a level of communication with the large-diameter portion, wherein an average diameter of the large-diameter portion at the surface of the anodized film is at least 10 nm but less than 30 nm and a ratio of the depth A to the average diameter (depth A/average diameter) of the large-diameter portion is more than 4.0 but up to 12.0, and wherein an average diameter of the small-diameter portion at the level of communication is more than 0 but less than 10.0 nm.

(2) The lithographic printing plate support according to (1), wherein the small-diameter portion includes a first small-diameter portion and a second small-diameter portion that are different in average depth from each other, wherein the first small-diameter portion is larger in average depth than the second small-diameter portion, and wherein the anodized film between a bottom of the first small-diameter portion and a surface of the aluminum plate has an average thickness of at least 17 nm and a minimum thickness of at least 15 nm.

(3) The lithographic printing plate support according to (1) or (2), wherein a first small-diameter portion density is 550 to 700 pcs/$\mu m^2$.

(4) The lithographic printing plate support according to any one of (1) to (3), wherein a difference in average depth between the first small-diameter portion and the second small-diameter portion is 75 to 200 nm.

(5) The lithographic printing plate support according to any one of (1) to (4), wherein the large-diameter portion has a diameter gradually increasing from the surface of the anodized film toward the aluminum plate whereby an average diameter (bottom average diameter) of the large-diameter portion at the level of communication is larger than an average diameter (surface layer average diameter) of the large-diameter portion at the surface of the anodized film; the bottom average diameter is more than 10 nm but up to 60 nm; and a ratio of the depth A to the bottom average diameter (depth A/bottom average diameter) is at least 1.2 but less than 12.0.

(6) The lithographic printing plate support according to (5), wherein a surface area increase rate of the large-diameter portion is expressed by Equation (A):

$$(\text{Surface area increase rate})=1+\text{Pore density}\times((\pi\times(\text{Surface layer average diameter}/2)\times((\text{Bottom average diameter}/2-\text{Surface layer average diameter}/2)^2+\text{Depth } A^2)^{1/2}+\pi\times(\text{Bottom average diameter}/2)^2-\pi\times(\text{Surface layer average diameter}/2)^2))$$

and the surface area increase rate is 1.9 to 16.0.

(7) The lithographic printing plate support according to any one of (1) to (6), wherein a ratio of the average diameter of the large-diameter portion at the surface of the anodized film to the average diameter of the small-diameter portion at the level of communication (large-diameter portion average diameter/small-diameter portion average diameter) is more than 1.00 but up to 1.50.

(8) A lithographic printing plate precursor, comprising: the lithographic printing plate support according to any one of (1) to (7); and an image recording layer formed thereon.

(9) A lithographic printing plate support manufacturing method of manufacturing the lithographic printing plate support according to any one of (1) to (7), comprising:

a first anodizing treatment step for anodizing the aluminum plate; and a second anodizing treatment step for further anodizing the aluminum plate having the anodized film obtained in the first anodizing treatment step.

The present invention can provide a lithographic printing plate support that has excellent scratch resistance, enables a lithographic printing plate formed therefrom to have a long press life and is capable of obtaining a lithographic printing plate precursor exhibiting excellent on-press developability; a method of manufacturing such a lithographic printing plate support; and a lithographic printing plate precursor. Furthermore, a lithographic printing plate using the lithographic printing plate support according to the present invention has properties of substantially equivalent degree to those of the prior art in terms of deinking ability in continued printing and after suspended printing. In addition, the lithographic printing plate support obtained in the present invention exhibits excellent scratch resistance.

DETAILED DESCRIPTION OF THE INVENTION

The lithographic printing plate support and its manufacturing method according to the invention are described below.

The lithographic printing plate support of the invention includes an aluminum plate and an anodized film formed thereon, each of micropores in the anodized film being of such a shape that a large-diameter portion having a larger average diameter communicates with a small-diameter portion having a smaller average diameter along the depth direction (i.e., the thickness direction of the film). Particularly in the invention, although the press life has been deemed to have a trade-off relation with the on-press developability, these properties can be simultaneously achieved at a higher level by controlling the average diameter and average depth of the large-diameter portions having a larger average diameter in the micropores.

Figure 1:
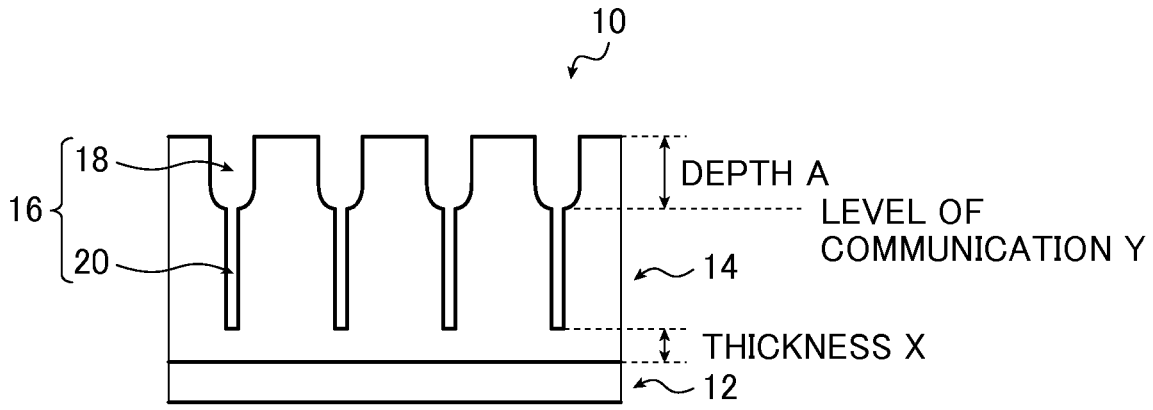
FIG. 1 is a schematic cross-sectional view showing an embodiment of a lithographic printing plate support of the invention.

FIG. 1 is a schematic cross-sectional view showing an embodiment of the lithographic printing plate support of the invention.

A lithographic printing plate support 10 shown in the drawing is of a laminated structure in which an aluminum plate 12 and an anodized aluminum film 14 (hereinafter also simply called "anodized film") are stacked in this order. The anodized film 14 has micropores 16 extending from its surface toward the aluminum plate 12 side, and each micropore 16 has a large-diameter portion 18 and a small-diameter portion 20. The term "micropore" used herein is commonly used to denote a pore in the anodized film and does not define the size of the pore.

The aluminum plate 12 and the anodized film 14 are first described in detail.

<Aluminum Plate>

The aluminum plate 12 (aluminum support) used in the invention is made of a dimensionally stable metal composed primarily of aluminum; that is, aluminum or aluminum alloy. The aluminum plate is selected from among plates of pure aluminum, alloy plates composed primarily of aluminum and containing small amounts of other elements, and plastic films or paper on which aluminum (alloy) is laminated or vapor-deposited. In addition, a composite sheet as described in JP 48-18327 B in which an aluminum sheet is attached to a polyethylene terephthalate film may be used.

In the following description, the above-described plates made of aluminum or aluminum alloys are referred to collectively as "aluminum plate 12." Other elements which may be present in the aluminum alloy include silicon, iron, manganese, copper, magnesium, chromium, zinc, bismuth, nickel and titanium. The content of other elements in the alloy is not more than 10 wt %. In the invention, the aluminum plate used is preferably made of pure aluminum but may contain small amounts of other elements because it is difficult to manufacture completely pure aluminum from the viewpoint of smelting technology. The aluminum plate 12 which is applied to the invention as described above is not specified for its composition but conventionally known materials such as JIS A1050, JIS A1100, JIS A3103 and JIS A3005 materials can be appropriately used.

The aluminum plate 12 used in the invention is treated as it continuously travels usually in a web form, and has a width of about 400 mm to about 2,000 mm and a thickness of about 0.1 mm to about 0.6 mm. The width and thickness may be changed as appropriate based on such considerations as the size of the printing press, the size of the printing plate and the desires of the user.

The aluminum plate is appropriately subjected to substrate surface treatments to be described later.

<Anodized Film>

The anodized film 14 refers to an anodized aluminum film (alumina film) that is generally formed at a surface of the aluminum plate 12 by anodizing treatment and has the micropores 16 which are substantially perpendicular to the film surface and are distributed in a uniform manner. The micropores 16 extend along the thickness direction of the anodized film 14 from the surface of the anodized film opposite to the aluminum plate 12 (toward the aluminum plate 12 side).

Each micropore 16 in the anodized film 14 has the large-diameter portion 18 which extends from the anodized film surface to an average depth of 75 to 120 nm (depth A: see FIG. 1), and the small-diameter portion 20 which communicates with the bottom of the large-diameter portion 18 and further extends from the level of communication (communication level Y: see FIG. 1) to an average depth of 900 to 2,000 nm.

The large-diameter portion 18 and the small-diameter portion 20 are described below in detail.

(Large-Diameter Portion)

The large-diameter portions 18 have an average diameter (average aperture size) of 10 nm or more but less than 30 nm at the surface of the anodized film 14. At an average diameter within the foregoing range, the lithographic printing plate obtained using the lithographic printing plate support has a long press life, and the lithographic printing plate precursor obtained using the support has a long press life, excellent on-press developability and excellent deinking ability in continued printing and after suspended printing. In particular, in terms of longer press life, the average diameter is preferably from 10 to 25 nm, more preferably from 11 to 15 nm and even more preferably from 11 to 13 nm.

At an average diameter of less than 10 nm, a sufficient anchor effect is not obtained, nor is the press life of the lithographic printing plate improved. At an average diameter of 30 nm or more, the roughened surface is damaged whereby the press life cannot be improved.

The average diameter of the large-diameter portions 18 is determined as follows: The surface of the anodized film 14 is observed with FE-SEM at a magnification of 150,000× to obtain four images (N=4), in the resulting four images, the diameter of the micropores (large-diameter portions) within an area of 400×600 $nm^2$ is measured, and the average of the measurements is calculated.

The equivalent circle diameter is used if the shape of the large-diameter portion 18 is not circular. The "equivalent circle diameter" refers to a diameter of a circle assuming that the shape of the aperture is the circle having the same projected area as that of the aperture.

The bottom of each large-diameter portion 18 is at an average depth of 75 to 120 nm from the surface of the anodized film (hereinafter also referred to as "depth A"). In other words, each large-diameter portion 18 is a pore portion which extends from the surface of the anodized film in the depth direction (thickness direction) to a depth of 75 to 120 nm. At an average depth within the foregoing range, the lithographic printing plate obtained using the lithographic printing plate support has a long press life, and the lithographic printing plate precursor obtained using the support has excellent on-press developability. In particular, the depth A is preferably 85 to 110 nm and more preferably 85 to 105 nm because the press life and on-press developability are more excellent.

At an average depth of less than 75 nm, a sufficient anchor effect is not obtained, and the lithographic printing plate has a shorter press life. At an average depth in excess of 120 nm, the lithographic printing plate precursor has poor on-press developability.

The average depth is determined as follows: The distance from the anodized film surface to the communication level in cross-section of the anodized film is observed with FE-TEM at a magnification of 500,000×, the depth of 60 (N=60) micropores (large-diameter portions) is measured, and the average of the measurements is calculated. For the cross-section measurement of the anodized film, a known method may be adopted (for instance, the anodized film is cut by FIB to prepare a thin film (about 50 nm) to thereby perform the cross-section measurement of the anodized film 14).

The ratio of the depth A at which the bottoms of the large-diameter portions 18 are positioned to the average diameter of the large-diameter portions 18 (depth A/average diameter) is more than 4.0 but up to 12.0. At a ratio within the foregoing range, the lithographic printing plate obtained using the lithographic printing plate support has a long press life, and the lithographic printing plate precursor obtained using the support has excellent on-press developability. In particular, the ratio (depth A/average diameter) is preferably 5.6 to 10.0 and more preferably 6.5 to 9.6 because the press life and on-press developability are more excellent.

At a ratio (depth A/average diameter) of 4.0 or less, the lithographic printing plate has poor deinking ability in continued printing and the lithographic printing plate precursor has poor on-press developability. At a ratio (depth A/average diameter) in excess of 12.0, the lithographic printing plate has a shorter press life.

The shape of the large-diameter portions 18 is not particularly limited. Exemplary shapes include a substantially straight tubular shape (substantially columnar shape), an inverted cone shape (tapered shape) in which the diameter decreases from the surface of the anodized film toward the aluminum plate 12 and a substantially conical shape (inversely tapered shape) in which the diameter increases from the surface of the anodized film toward the aluminum plate 12. A substantially straight tubular shape or an inversely tapered shape is preferred.

When the large-diameter portions 18 are in a substantially straight tubular shape, the large-diameter portions 18 may have a difference of about 1 nm to about 5 nm between the internal diameter and the aperture diameter at the surface of the anodized film 14.

Figure 2:
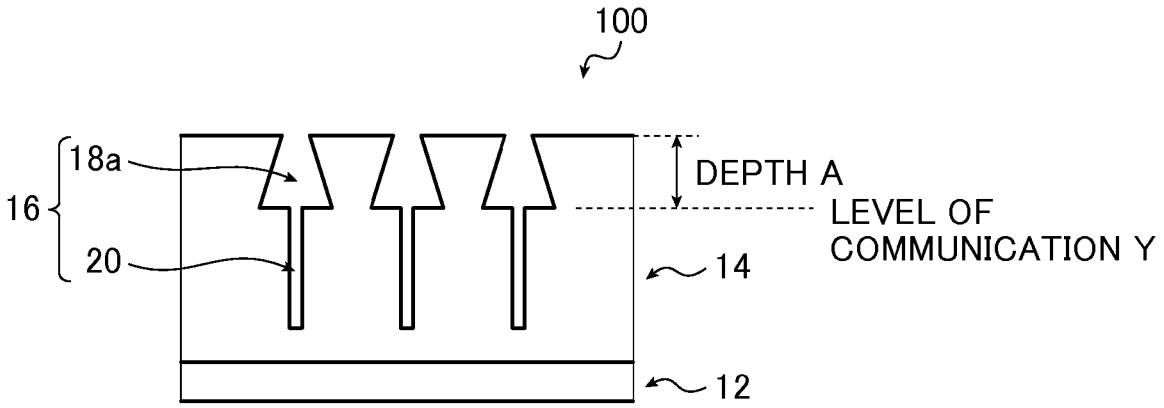
FIG. 2 is a schematic cross-sectional view showing a modification of the embodiment of the lithographic printing plate support of the invention.

The case where a large-diameter portion 18*a* is in a substantially conical shape (inversely tapered shape) in which the diameter increases from the surface of the anodized film 14 toward the aluminum plate 12 is shown in FIG. 2.

The diameter (internal diameter) of the large-diameter portions 18*a* in a lithographic printing plate support 100 gradually increases from the surface of the anodized film 14 toward the aluminum plate 12 side. The shape of the large-diameter portions 18*a* is not particularly limited as long as the above diameter condition is met, and is a substantially conical shape or a substantially bell shape in general. The large-diameter portions having the foregoing structure enable the resulting lithographic printing plate to have excellent properties in terms of press life, deinking ability in continued printing and after suspended printing, and the like.

In FIG. 2, the average diameter of the large-diameter portions 18*a* at the surface of the anodized film 14 (surface layer average diameter) is smaller than the average diameter of the large-diameter portions 18*a* at the level Y of communication with the corresponding small-diameter portions 20 (bottom average diameter). The magnitude of the bottom average diameter is not particularly limited and is preferably more than 10 nm but up to 60 nm and more preferably 20 to 30 nm. At the bottom average diameter within the foregoing range, the lithographic printing plate has excellent properties in terms of deinking ability in continued printing and after suspended printing, on-press developability, and the like.

The ratio of the depth A to the bottom average diameter (depth A/bottom average diameter) is not particularly limited and is preferably 1.2 or more but less than 12.0 and more preferably 2.5 to 6.0. At a ratio of the depth A to the bottom average diameter within the foregoing range, the lithographic printing plate has excellent properties in terms of press life, deinking ability in continued printing and after suspended printing, and the like.

The bottom average diameter is determined as follows: The cross-section of the anodized film 14 is observed with FE-TEM at a magnification of 500,000×, the diameter of 60 (N=60) large-diameter portions 18*a* at the communication level Y is measured, and the average of the measurements is calculated. For the cross-section measurement of the anodized film, a known method may be adopted. For instance, the anodized film 14 is cut by FIB to prepare a thin film (about 50 nm) to thereby perform the cross-section measurement of the anodized film 14.

In FIG. 2, the surface area increase rate of the large-diameter portions 18*a* expressed by Equation (A) below is preferably 1.9 to 16.0 and more preferably 2.1 to 11.7. At a surface area increase rate within the foregoing range, the lithographic printing plate has excellent properties in terms of press life, deinking ability in continued printing or after suspended printing or on-press developability.

$$\text{(Surface area increase rate)}=1+\text{Pore density}\times((\pi\times(\text{Surface layer average diameter}/2+\text{Bottom average diameter}/2)\times((\text{Bottom average diameter}/2-\text{Surface layer average diameter}/2)^2+\text{Depth } A^2)^{1/2}+\pi\times(\text{Bottom average diameter}/2)^2-\pi\times(\text{Surface layer average diameter}/2)^2)) \quad \text{Equation (A)}$$

For Equation (A) above, an area of 1 μm×1 μm at the surface of the anodized film is first observed. Equation (A) above expresses how much the surface area is increased within the above area due to formation of the large-diameter portions. More specifically, "1" in Equation (A) above represents the area of 1 μm×1 μm at the surface of the anodized film. In Equation (A), "$\pi\times$(Surface layer average diameter/2+Bottom average diameter/2)×((Bottom average diameter/2−Surface layer average diameter/2)$^2$+Depth A$^2$)$^{1/2}$" represents the surface area of the side surface of the large-diameter portion, "$\pi\times$(Bottom average diameter/2)$^2$" represents the area of the bottom of a large-diameter portion and "$\pi\times$(Surface layer average diameter/2)$^2$" represents the area of the aperture of a large-diameter portion at the surface of the anodized film.

The bottom shape of the large-diameter portions 18 is not particularly limited and may be curved (convex) or flat.

(Small-Diameter Portion)

As shown in FIG. 1, each of the small-diameter portions 20 is a pore portion which communicates with the bottom of the corresponding large-diameter portion 18 and further extends from the communication level Y in the depth direction (thickness direction). One small-diameter portion 20 usually communicates with one large-diameter portion 18 but two or more small-diameter portions 20 may communicate with the bottom of one large-diameter portion 18.

The small-diameter portions 20 have an average diameter at the communication level of more than 0 but less than 10.0 nm. In particular, the average diameter is preferably not more than 9.5 nm and more preferably not more than 9.0 nm in terms of on-press developability or deinking ability in continued printing or after suspended printing.

At an average diameter of 10.0 nm or more, the lithographic printing plate obtained using the lithographic printing plate support of the invention has a shorter press life and the lithographic printing plate precursor has poor on-press developability.

The average diameter of the small-diameter portions 20 is determined as follows: The surface of the anodized film 14 is observed with FE-SEM at a magnification of 150,000× to obtain four images (N=4), in the resulting four images, the diameter of the micropores (small-diameter portions) within an area of 400×600 nm$^2$ is measured, and the average of the measurements is calculated. When the depth of the large-diameter portions is large, the average diameter of the small-diameter portions may be optionally determined by cutting out the upper region of the anodized film 14 (including the large-diameter portions) (for example, cutting out the same by argon gas) and observing the surface of the anodized film 14 with FE-SEM.

The equivalent circle diameter is used if the shape of the small-diameter portion 20 is not circular. The "equivalent circle diameter" refers to a diameter of a circle assuming that the shape of the aperture is the circle having the same projected area as that of the aperture.

The bottom of each small-diameter portion 20 is at a distance of 900 to 2,000 nm in the depth direction from the level of communication with the corresponding large-diameter portion 18 (the level corresponding to the above-mentioned depth A). In other words, the small-diameter portions 20 are pore portions each of which further extends in the depth direction (thickness direction) from the level of communication with the corresponding large-diameter portion 18 and the small-diameter portions 20 have an average depth of 900 to 2,000 nm. The bottom of each small-diameter portion is preferably at a depth of 900 to 1,500 nm from the communication level in terms of the scratch resistance of the lithographic printing plate support.

At an average depth of less than 900 nm, the lithographic printing plate support has poor scratch resistance. An average depth in excess of 2,000 nm requires a prolonged treatment time and reduces the productivity and economic efficiency.

The average depth is determined by taking a cross-sectional image of the anodized film 14 with FE-SEM (at a magnification of 50,000×), measuring the depth of at least 25 small-diameter portions and calculating the average of the measurements.

The ratio between the average diameter of the large-diameter portions 18 at the surface of the anodized film and that of the small-diameter portions 20 at the communication level (large-diameter portion diameter/small-diameter portion diameter) is not particularly limited and is preferably more than 1.00 but up to 1.50, more preferably 1.10 to 1.40 and most preferably 1.10 to 1.30. At a ratio within the foregoing range, the lithographic printing plate has a longer press life or more excellent on-press developability.

The density of the small-diameter portions 20 in the cross section of the anodized film 14 at the communication level Y is not particularly limited and is preferably 100 to 5,000 pcs/$\mu m^2$ and more preferably 600 to 1,200 pcs/$\mu m^2$. At a density within the foregoing range, the lithographic printing plate has further improved on-press developability or deinking ability in continued printing or after suspended printing.

The shape of the small-diameter portions 20 is not particularly limited. Exemplary shapes include a substantially straight tubular shape (substantially columnar shape), and a conical shape in which the diameter decreases in the depth direction, and a substantially straight tubular shape is preferred. The small-diameter portions 20 may extend from the communication level Y toward the aluminum plate 12 while branching off.

The bottom shape of the small-diameter portions 20 is not particularly limited and may be curved (convex) or flat.

The internal diameter of the small-diameter portions 20 is not particularly limited and may be usually substantially equal to, or smaller or larger than the diameter at the communication level. There may be usually a difference of about 1 nm to about 10 nm between the internal diameter of the small-diameter portions 20 and the aperture diameter of the same.

The thickness of the anodized film between the bottom of each small-diameter portion 20 and the surface of the aluminum plate 12 (which corresponds to the thickness X in FIG. 1) is not particularly limited and is preferably 7 to 50 nm and more preferably 20 to 30 nm. The portion corresponding to the thickness X in the anodized film is also called "barrier layer." A thickness X within the above-defined range leads to more excellent resistance to microdotted scumming.

The value of the thickness X above is an average obtained by measuring the thickness of the anodized film between the bottom of each of at least 50 small-diameter portions 20 and the surface of the aluminum plate 12 and calculating the arithmetic mean of the measurements.

Figure 8:
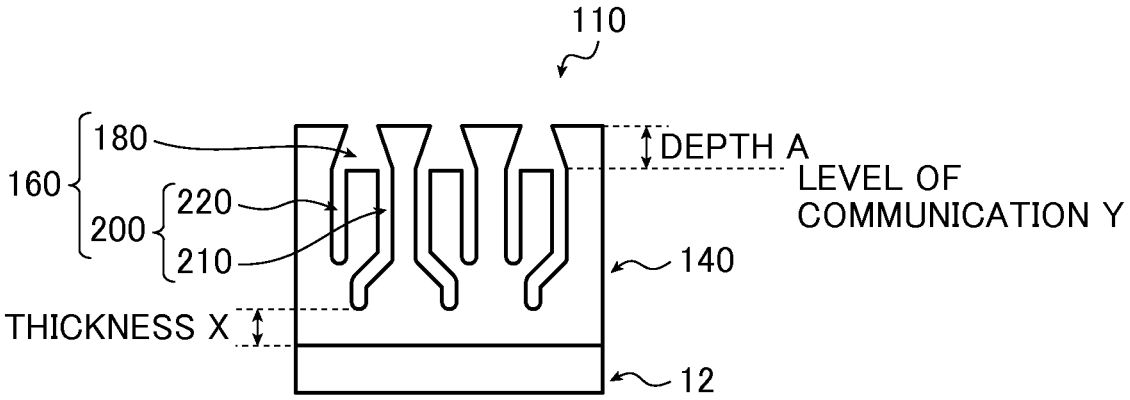
FIG. 8 is a schematic cross-sectional view showing a preferred embodiment of the lithographic printing plate support of the invention.

One of preferred embodiments of the anodized film described above is as shown in FIG. 8. A lithographic printing plate support 110 shown in FIG. 8 is of a laminated structure in which the aluminum plate 12 and an anodized aluminum film 140 are stacked in this order. The anodized film 140 has micropores 160 extending from the surface of the anodized film toward the aluminum plate 12 side, and each micropore 160 has a large-diameter portion 180 and a small-diameter portion 200.

The large-diameter portions 180 have a substantially conical shape (inversely tapered shape) in which the diameter increases from the surface of the anodized film 140 toward the aluminum plate 12 side as described above with reference to FIG. 2. The ranges of the surface layer average diameter, the bottom average diameter, the ratio (depth A/bottom average diameter), the surface area increase rate, and the like of the large-diameter portions 180 are as described above.

Each of the small-diameter portions 200 is a pore portion which communicates with the bottom of the corresponding large-diameter portion 180 and further extends from the communication level Y in the depth direction (thickness direction). While in FIG. 8, two small-diameter portions 200 communicate with one large-diameter portion 180, the invention is not limited to this configuration and one or two or more small-diameter portions 200 may communicate with one large-diameter portion 180.

The average diameter of the small-diameter portions 200 at the communication level as well as its preferred range is defined in the same manner as the above-described average diameter of the small-diameter portions 20.

The average depth of the small-diameter portions 200 as well as its preferred range is defined in the same manner as the above-described average depth of the small-diameter portions 20.

The ratio between the average diameter of the large-diameter portions 180 at the surface of the anodized film and that of the small-diameter portions 200 at the communication level (large-diameter portion diameter/small-diameter portion diameter) as well as its preferred range is defined in the same manner as the above-described ratio between the average diameter of the large-diameter portions 18 at the surface of the anodized film and that of the small-diameter portions 20 at the communication level (large-diameter portion diameter/small-diameter portion diameter).

Each of the small-diameter portions 200 includes a first small-diameter portion 210 and a second small-diameter portion 220 that are different in average depth from each other.

The first small-diameter portions 210 are larger in average depth than the second small-diameter portions 220. In other words, the bottom of each first small-diameter portion 210 is positioned closer to the aluminum plate 12 than the bottom of each second small-diameter portion 220.

The average depths of the first and second small-diameter portions 210 and 220 are determined as follows. First, of the small-diameter portions, the shortest small-diameter portion (hereinafter called "minimum small-diameter portion") and the longest small-diameter portion (hereinafter called "maximum small-diameter portion") are selected, and a small-diameter portion whose bottom is at a level closer to the bottom of the minimum small-diameter portion is selected as a second small-diameter portion while a small-diameter portion whose bottom is at a level closer to the bottom of the maximum small-diameter portion is selected as a first small-diameter portion. A small-diameter portion whose bottom is at a middle level between the bottom of the minimum small-diameter portion and that of the maximum small-diameter portion is selected as a first small-diameter portion. The depth of at least 25 small-diameter portions among the selected first small-diameter portions is measured and the arithmetic mean of the measurements is calculated to thereby obtain the average depth of the first small-diameter portions. The depth of at least 25 small-diameter portions among the selected second small-diameter portions is measured and the arithmetic mean of the measurements is calculated to thereby obtain the average depth of the second small-diameter portions.

The difference between the average depth of the first small-diameter portions 210 and that of the second small-diameter portions 220 is not particularly limited and is preferably 75 to 200 nm and more preferably 100 to 200 nm in terms of resistance to dotted scumming.

The density of the small-diameter portions 200 in the cross section of the anodized film 140 at the communication level Y is not particularly limited and is preferably 100 to 5,000 pcs/$\mu m^2$ and more preferably 600 to 1,200 pcs/$\mu m^2$. At a density within the foregoing range, the lithographic printing plate has further improved on-press developability or deinking ability in continued printing or after suspended printing.

The density of the first small-diameter portions 210 is not particularly limited and is preferably 550 to 700 pcs/$\mu m^2$ and more preferably 550 to 650 pcs/$\mu m^2$ in terms of resistance to dotted scumming.

The average thickness X of the anodized film between the bottom of each first small-diameter portion 210 and the surface of the aluminum plate 12 is not particularly limited and is preferably at least 17 nm and more preferably at least 18 nm in terms of resistance to dotted scumming. The upper limit of the average thickness is not particularly limited but is usually up to 30 nm.

The average thickness above is a value obtained by measuring the thickness of the anodized film between the bottom of each of at least 50 first small-diameter portions 210 and the surface of the aluminum plate 12 and calculating the arithmetic mean of the measurements.

The minimum thickness of the anodized film between the bottom of each first small-diameter portion 210 and the surface of the aluminum plate 12 is not particularly limited and is preferably at least 15 nm and more preferably at least 17 nm.

The shapes of the first and second small-diameter portions 210 and 220 are not particularly limited. Exemplary shapes include a substantially straight tubular shape (substantially columnar shape). Besides, the internal diameter of the first small-diameter portions 210 may be increased at a level between the bottoms of the second small-diameter portions 220 and the aluminum plate 12 (by, for instance, about 1 nm to about 10 nm).

<Lithographic Printing Plate Support Manufacturing Method>

A method of manufacturing the lithographic printing plate support of the invention is described below.

The method of manufacturing the lithographic printing plate support of the invention is not particularly limited and a manufacturing method in which the following steps are performed in order is preferred.

(Surface roughening treatment step) Step of performing surface roughening treatment on an aluminum plate;

(First anodizing treatment step) Step of anodizing the aluminum plate having undergone surface roughening treatment;

(Pore-widening treatment step) Step of enlarging the diameter of micropores in an anodized film by bringing the aluminum plate having the anodized film obtained in the first anodizing treatment step into contact with an aqueous acid or alkali solution;

(Second anodizing treatment step) Step of anodizing the aluminum plate obtained in the pore-widening treatment step;

(Third anodizing treatment step) Step of anodizing the aluminum plate obtained in the second anodizing treatment step; and (Hydrophilizing treatment step) Step of hydrophilizing the aluminum plate obtained in the second or third anodizing treatment step.

The respective steps are described below in detail. The surface roughening treatment step, the pore-widening treatment step, the hydrophilizing treatment step and the third anodizing treatment step are not essential steps.

FIG. 3 shows schematic cross-sectional views of the substrate and the anodized film in order of steps, from the first anodizing treatment step to the third anodizing treatment step.

<Surface Roughening Treatment Step>

The surface roughening treatment step is a step in which the surface of the aluminum plate is subjected to surface roughening treatment including electrochemical graining treatment. This step is preferably performed before the first anodizing treatment step to be described later but may not be performed if the aluminum plate already has a preferred surface profile.

The surface roughening treatment may include solely electrochemical graining treatment, or a combination of electrochemical graining treatment with mechanical graining treatment and/or chemical graining treatment.

In cases where mechanical graining treatment is combined with electrochemical graining treatment, mechanical graining treatment is preferably followed by electrochemical graining treatment.

In the practice of the invention, electrochemical graining treatment is preferably carried out in an aqueous solution of nitric acid or hydrochloric acid.

Mechanical graining treatment is generally performed in order that the surface of the aluminum plate may have a surface roughness $R_a$ of 0.35 to 1.0 μm.

In the invention, mechanical graining treatment is not particularly limited for its conditions and can be performed according to the method described in, for example, JP 50-40047 B. Mechanical graining treatment can be carried out by brush graining using a suspension of pumice or a transfer system.

Chemical graining treatment is not particularly limited, either, and may be carried out by any known method.

Mechanical graining treatment is preferably followed by chemical etching treatment described below.

The purpose of chemical etching treatment following mechanical graining treatment is to smooth edges of irregularities at the surface of the aluminum plate to prevent ink from catching on the edges during printing, to improve the scumming resistance of the lithographic printing plate, and to remove abrasive particles or other unnecessary substances remaining on the surface.

Chemical etching processes including etching using an acid and etching using an alkali are known, and an exemplary method which is particularly excellent in terms of etching efficiency includes chemical etching treatment using an alkali solution (hereinafter also called "alkali etching treatment").

Alkaline agents that may be used in the alkali solution are not particularly limited and illustrative examples of suitable alkaline agents include sodium hydroxide, potassium hydroxide, sodium metasilicate, sodium carbonate, sodium aluminate, and sodium gluconate.

The alkaline agents may contain aluminum ions. The alkali solution has a concentration of preferably at least 0.01 wt % and more preferably at least 3 wt %, but preferably not more than 30 wt % and more preferably not more than 25 wt %.

The temperature of the alkali solution is preferably room temperature or higher and more preferably at least 30° C., but preferably not more than 80° C. and more preferably not more than 75° C.

The etching amount is preferably at least 0.1 $g/m^2$ and more preferably at least 1 $g/m^2$, but preferably not more than 20 $g/m^2$ and more preferably not more than 10 $g/m^2$.

The treatment time is preferably from 2 seconds to 5 minutes depending on the etching amount and more preferably from 2 to 10 seconds in terms of improving the productivity.

In cases where mechanical graining treatment is followed by alkali etching treatment in the invention, chemical etching treatment using an acid solution at a low temperature (hereinafter also referred to as "desmutting treatment") is preferably carried out to remove substances produced by alkali etching treatment.

Acids that may be used in the acid solution are not particularly limited and illustrative examples thereof include sulfuric acid, nitric acid and hydrochloric acid. The acid solution preferably has a concentration of 1 to 50 wt %. The acid solution preferably has a temperature of 20 to 80° C. When the concentration and temperature of the acid solution fall within the above-defined ranges, the lithographic printing plate obtained by using the lithographic printing plate support of the invention has more improved resistance to dotted scumming.

In the practice of the invention, the surface roughening treatment is a treatment in which electrochemical graining treatment is carried out after mechanical graining treatment and chemical etching treatment are carried out as desired, but even in cases where electrochemical graining treatment is carried out without performing mechanical graining treatment, electrochemical graining treatment may be preceded by chemical etching treatment using an aqueous solution of alkali such as sodium hydroxide. In this way, impurities and the like which are present in the vicinity of the surface of the aluminum plate can be removed.

Electrochemical graining treatment easily forms fine irregularities (pits) at the surface of the aluminum plate and is therefore suitable to prepare a lithographic printing plate having excellent printability.

Electrochemical graining treatment is carried out in an aqueous solution containing nitric acid or hydrochloric acid as its main ingredient using direct or alternating current.

Electrochemical graining treatment is preferably followed by chemical etching treatment described below. Smut and intermetallic compounds are present at the surface of the aluminum plate having undergone electrochemical graining treatment. In chemical etching treatment following electrochemical graining treatment, it is preferable for chemical etching treatment using an alkali solution (alkali etching treatment) to be first carried out in order to particularly remove smut with high efficiency. The conditions in chemical etching treatment using an alkali solution preferably include a treatment temperature of 20 to 80° C. and a treatment time of 1 to 60 seconds. It is desirable for the alkali solution to contain aluminum ions.

In order to remove substances generated by chemical etching treatment using an alkali solution following electrochemical graining treatment, it is further preferable to carry out chemical etching treatment using an acid solution at a low temperature (desmutting treatment).

Even in cases where electrochemical graining treatment is not followed by alkali etching treatment, desmutting treatment is preferably carried out to remove smut efficiently.

In the practice of the invention, chemical etching treatment described above is not particularly limited and may be carried out by immersion, showering, coating or other process.

<First Anodizing Treatment Step>

Figure 3A:
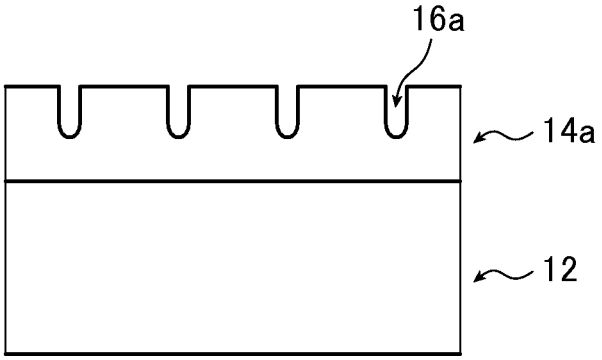
FIGS. 3A to 3D include schematic cross-sectional views showing a substrate and an anodized film in the order of process steps in a method of manufacturing the lithographic printing plate support of the invention.

The first anodizing treatment step is a step in which an anodized aluminum film having micropores which extend in the depth direction (thickness direction) of the film is formed at the surface of the aluminum plate by performing anodizing treatment on the aluminum plate having undergone the above-described surface roughening treatment. As shown in FIG. 3A, as a result of the first anodizing treatment, an anodized aluminum film 14*a* bearing micropores 16*a* is formed at a surface of the aluminum plate 12.

The first anodizing treatment may be performed by a known method in the art but the manufacturing conditions are appropriately set so that the foregoing micropores 16 may be finally formed.

More specifically, the average diameter (average aperture diameter) of the micropores 16*a* formed in the first anodizing treatment step is typically from about 4 nm to about 14 nm and preferably 5 to 10 nm. At an average aperture diameter within the foregoing range, the micropores 16 having the foregoing specified shapes are easily formed and the resulting lithographic printing plate and lithographic printing plate precursor have more excellent properties.

The micropores 16*a* usually have a depth of about 65 nm to about 110 nm and preferably 75 to 95 nm. At a depth within the foregoing range, the micropores 16 having the foregoing specified shapes are easily formed and the resulting lithographic printing plate and lithographic printing plate precursor have more excellent properties.

The density of the micropores 16*a* is not particularly limited and is preferably 50 to 4,000 pcs/$\mu m^2$ and more preferably 100 to 3,000 pcs/$\mu m^2$. At a micropore density within the foregoing range, the resulting lithographic printing plate has a long press life and excellent deinking ability after suspended printing and the lithographic printing plate precursor has excellent on-press developability.

The anodized film obtained by the first anodizing treatment step preferably has a thickness of 75 to 120 nm and more preferably 85 to 105 nm. At a film thickness within the foregoing range, the lithographic printing plate using the lithographic printing plate support obtained after this step has a long press life, excellent deinking ability after suspended printing, excellent resistance to dotted scumming, and excellent resistance to white spot formation, and the lithographic printing plate precursor has excellent on-press developability.

In addition, the anodized film obtained by the first anodizing treatment step preferably has a coating weight of 0.18 to 0.29 g/$m^2$ and more preferably 0.2 to 0.25 g/$m^2$. At a coating weight within the foregoing range, the lithographic printing plate using the lithographic printing plate support obtained after the foregoing steps has a long press life, excellent deinking ability after suspended printing, excellent resistance to dotted scumming, and excellent resistance to white spot formation, and the lithographic printing plate precursor has excellent on-press developability.

In the first anodizing treatment step, aqueous solutions of acids such as sulfuric acid, phosphoric acid and oxalic acid may be mainly used for the electrolytic bath. An aqueous solution or non-aqueous solution containing chromic acid, sulfamic acid, benzenesulfonic acid or a combination of two or more thereof may optionally be used. The anodized film can be formed at the surface of the aluminum plate by passing direct current or alternating current through the aluminum plate in the foregoing electrolytic bath.

The electrolytic bath may contain aluminum ions. The aluminum ion content is not particularly limited and is preferably from 1 to 10 g/L.

The anodizing treatment conditions are appropriately set depending on the electrolytic solution employed. However, the following conditions are generally suitable: an electrolyte concentration of from 1 to 80 wt % (preferably from 5 to 20 wt %), a solution temperature of from 5 to 70° C. (preferably from 10 to 60° C.), a current density of from 0.5 to 60 A/$dm^2$ (preferably from 5 to 50 A/$dm^2$), a voltage of from 1 to 100 V (preferably from 5 to 50 V), and an electrolysis time of from 1 to 100 seconds (preferably from 5 to 60 seconds).

Of these anodizing treatment methods, the method described in GB 1,412,768 which involves anodizing in sulfuric acid at a high current density is preferred.

<Pore-Widening Treatment Step>

Figure 3B:
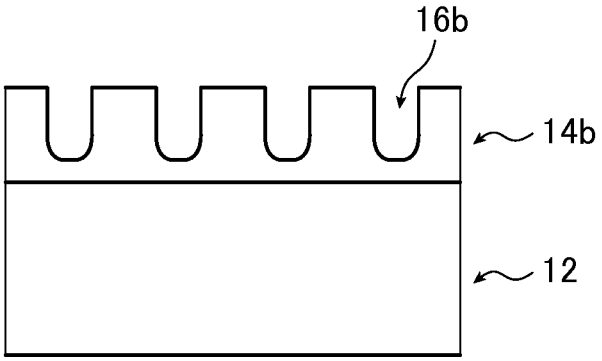

The pore-widening treatment step is a step for enlarging the diameter (pore size) of the micropores present in the anodized film formed by the above-described first anodizing treatment step (pore size-enlarging treatment). As shown in FIG. 3B, the pore-widening treatment enlarges the diameter of the micropores 16*a* to form an anodized film 14*b* bearing micropores 16*b* with a larger average diameter.

The pore-widening treatment preferably increases the average diameter of the micropores 16*b* to a range of 10 nm or more but less than 30 nm. The micropores 16*b* correspond to the above-described large-diameter portions 18.

The average depth of the micropores 16*b* from the film surface is preferably adjusted by this treatment so as to be approximately the same as the depth A.

The pore-widening treatment is performed by contacting the aluminum plate obtained by the above-described first anodizing treatment step with an aqueous acid or alkali solution. Examples of the contacting method include, but are not limited to, immersion and spraying. Of these, immersion is preferred.

When the pore-widening treatment step is to be performed with an aqueous alkali solution, it is preferable to use an aqueous solution of at least one alkali selected from the group consisting of sodium hydroxide, potassium hydroxide and lithium hydroxide. The aqueous alkali solution preferably has a concentration of 0.1 to 5 wt %.

The aluminum plate is suitably contacted with the aqueous alkali solution at 10° C. to 70° C. (preferably 20° C. to 50° C.) for 1 to 300 seconds (preferably 1 to 50 seconds) after the aqueous alkali solution is adjusted to a pH of 11 to 13.

The alkaline treatment solution may contain metal salts of polyvalent weak acids such as carbonates, borates and phosphates.

When the pore-widening treatment step is to be performed with an aqueous acid solution, it is preferable to use an aqueous solution of an inorganic acid such as sulfuric acid, phosphoric acid, nitric acid or hydrochloric acid, or a mixture thereof. The aqueous acid solution preferably has a concentration of 1 to 80 wt % and more preferably 5 to 50 wt %.

The aluminum plate is suitably contacted with the aqueous acid solution at 5° C. to 70° C. (preferably 10° C. to 60° C.) for 1 to 300 seconds (preferably 1 to 150 seconds).

The aqueous alkali or acid solution may contain aluminum ions. The content of the aluminum ions is not particularly limited and is preferably from 1 to 10 g/L.

<Second Anodizing Treatment Step>

Figure 3C:
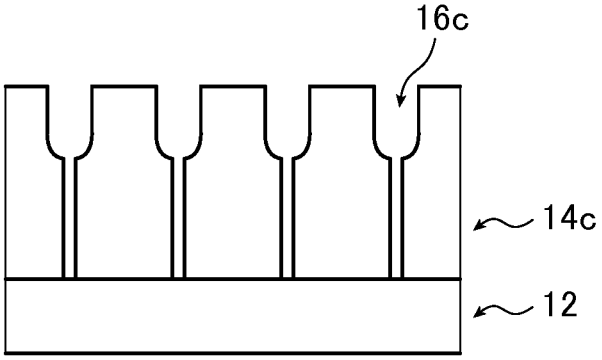

The second anodizing treatment step is a step in which micropores which further extend in the depth direction (thickness direction) of the film are formed by performing anodizing treatment on the aluminum plate having undergone the above-described pore-widening treatment. As shown in FIG. 3C, an anodized film 14*c* bearing micropores 16*c* which extend in the depth direction of the film is formed by the second anodizing treatment step.

The second anodizing treatment step forms new pores which communicate with the bottoms of the micropores 16*b* with the increased average diameter, have an average diameter smaller than that of the micropores 16*b* (corresponding to the large-diameter portions 18) and extend from the communication level in the depth direction. The pores correspond to the above-described small-diameter portions 20.

In the second anodizing treatment step, the treatment is performed so that the newly formed pores have an average diameter of more than 0 but less than 10 nm and an average depth from the level of communication with the large-diameter portions 18 within the foregoing specified range. The electrolytic bath used for the treatment is the same as used in the first anodizing treatment step and the treatment conditions are set as appropriate for the materials used.

The anodizing treatment conditions are appropriately set depending on the electrolytic solution employed. However, the following conditions are generally suitable: an electrolyte concentration of from 1 to 80 wt % (preferably from 5 to 20 wt %), a solution temperature of from 5 to 70° C. (preferably from 10 to 60° C.), a current density of from 0.5 to 60 A/dm$^2$ (preferably from 1 to 30 A/dm$^2$), a voltage of from 1 to 100 V (preferably from 5 to 50 V), and an electrolysis time of from 1 to 100 seconds (preferably from 5 to 60 seconds).

The anodized film obtained by the second anodizing treatment step usually has a thickness of 900 to 2,000 nm and preferably 900 to 1,500 nm. At a film thickness within the foregoing range, the lithographic printing plate using the lithographic printing plate support obtained after the foregoing steps has a long press life and excellent deinking ability after suspended printing, and the lithographic printing plate precursor has excellent on-press developability.

The anodized film obtained by the second anodizing treatment step usually has a coating weight of 2.2 to 5.4 g/m$^2$ and preferably 2.2 to 4.0 g/m$^2$. At a coating weight within the foregoing range, the lithographic printing plate using the lithographic printing plate support obtained after the foregoing steps has a long press life and excellent deinking ability after suspended printing, and the lithographic printing plate precursor has excellent on-press developability.

The ratio between the thickness of the anodized film obtained by the first anodizing treatment step (film thickness 1) and that of the anodized film obtained by the second anodizing treatment step (film thickness 2) (film thickness 1/film thickness 2) is preferably from 0.01 to 0.15 and more preferably from 0.02 to 0.10. At a ratio within the foregoing range, the lithographic printing plate support has excellent scratch resistance.

In order to obtain the shape of the small-diameter portions described above, the voltage applied may be increased stepwise or continuously during the treatment in the second anodizing treatment step. By increasing the applied voltage, the diameter of the pores formed is increased.

The thickness of the anodized film between the bottoms of the resulting small-diameter portions and the aluminum plate tends to increase by increasing the voltage applied in the second anodizing treatment step. In cases where the anodized film between the bottoms of the small-diameter portions and the aluminum plate has a predetermined thickness as a result of the foregoing treatment, the third anodizing treatment step to be described below may not be performed.

<Third Anodizing Treatment Step>

Figure 3D:
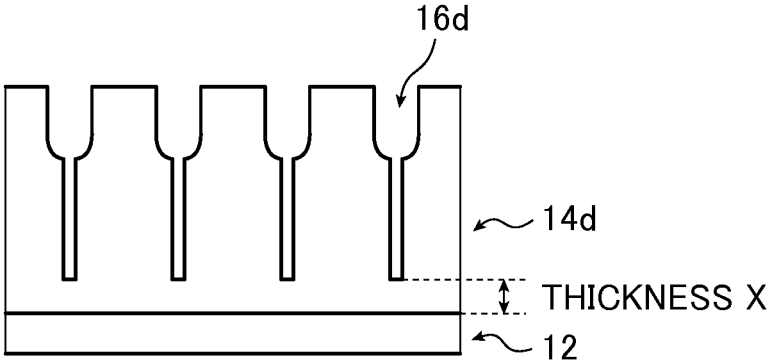

The third anodizing treatment step is a step in which the aluminum plate having undergone the second anodizing treatment is further anodized to mainly increase the thickness of the anodized film located between the bottoms of the small-diameter portions and the aluminum plate (thickness of the barrier layer). As shown in FIG. 3D, the thickness X reaches a predetermined value as a result of the third anodizing treatment step.

As described above, in cases where the micropores already have desired shapes at the end of the second anodizing treatment step, the third anodizing treatment step may not be performed.

The anodizing treatment conditions in the third anodizing treatment step are appropriately set depending on the electrolytic solution used but the treatment is usually performed at a higher voltage than that applied in the second anodizing treatment step.

The type of electrolytic solution used is not particularly limited and any of the above-described electrolytic solutions may be used. By using, for example, a boric acid-containing aqueous solution as the electrolytic bath, the thickness X can be efficiently increased without changing the shape of the small-diameter portions obtained by the second anodizing treatment.

The anodized film obtained by the third anodizing treatment step usually has a coating weight of 0.13 to 0.65 g/m$^2$ and preferably 0.26 to 0.52 g/m$^2$. At a coating weight within the foregoing range, the lithographic printing plate using the lithographic printing plate support obtained after the foregoing steps has a long press life, excellent deinking ability after suspended printing, excellent resistance to dotted scumming, and excellent resistance to white spot formation, and the lithographic printing plate precursor has excellent on-press developability.

The micropores may further extend toward the aluminum plate as a result of the third anodizing treatment step.

<Hydrophilizing Treatment Step>

The method of manufacturing the lithographic printing plate support of the invention may have a hydrophilizing treatment step in which hydrophilizing treatment is performed after the above-described second or third anodizing treatment step. Hydrophilizing treatment may be performed by the known method disclosed in paragraphs [0109] to [0114] of JP 2005-254638 A.

It is preferable to perform hydrophilizing treatment by a method in which the aluminum plate is immersed in an aqueous solution of an alkali metal silicate such as sodium silicate or potassium silicate, or is coated with a hydrophilic vinyl polymer or a hydrophilic compound so as to form a hydrophilic undercoat layer.

Hydrophilizing treatment with an aqueous solution of an alkali metal silicate such as sodium silicate or potassium silicate can be carried out according to the processes and procedures described in U.S. Pat. No. 2,714,066 and U.S. Pat. No. 3,181,461.

The lithographic printing plate support of the invention is preferably the one obtained by subjecting the foregoing aluminum plate to the treatments shown in the following Embodiment A or B in this order and Embodiment A is most preferably used in terms of the press life. Rinsing with water is desirably carried out between the respective treatments. However, in cases where solution of the same compositions are used in the consecutively carried out two steps (treatments), rinsing with water may be omitted.

Embodiment A (2) Chemical etching treatment in an aqueous alkali solution (first alkali etching treatment);

(3) Chemical etching treatment in an aqueous acid solution (first desmutting treatment);

(4) Electrochemical graining treatment in a nitric acid-based aqueous solution (first electrochemical graining treatment);

(5) Chemical etching treatment in an aqueous alkali solution (second alkali etching treatment);

(6) Chemical etching treatment in an aqueous acid solution (second desmutting treatment);

(7) Electrochemical graining treatment in a hydrochloric acid-based aqueous solution (second electrochemical graining treatment);

(8) Chemical etching treatment in an aqueous alkali solution (third alkali etching treatment);

(9) Chemical etching treatment in an aqueous acid solution (third desmutting treatment);

(10) Anodizing treatments (first anodizing treatment, pore-widening treatment, second anodizing treatment, third anodizing treatment); and

(11) Hydrophilizing treatment.

Embodiment B (2) Chemical etching treatment in an aqueous alkali solution (first alkali etching treatment);

(3) Chemical etching treatment in an aqueous acid solution (first desmutting treatment);

(12) Electrochemical graining treatment in a hydrochloric acid-based aqueous solution;

(5) Chemical etching treatment in an aqueous alkali solution (second alkali etching treatment);

(6) Chemical etching treatment in an aqueous acid solution (second desmutting treatment);

(10) Anodizing treatments (first anodizing treatment, pore-widening treatment, second anodizing treatment, third anodizing treatment); and

(11) Hydrophilizing treatment.

The treatment (2) in Embodiments A and B above may be optionally preceded by (1) mechanical graining treatment. The treatment (1) is preferably not included in either embodiment in terms of the press life and the like.

Mechanical graining treatment, electrochemical graining treatment, chemical etching treatment, anodizing treatment and hydrophilizing treatment in (1) to (12) described above may be carried out by the same treatment methods and conditions as those described above, but the treatment methods and conditions to be described below are preferably used to carry out such treatments.

Mechanical graining treatment is preferably performed using a rotating nylon brush roll having a bristle diameter of 0.2 to 1.61 mm and a slurry supplied to the surface of the aluminum plate.

Known abrasives may be used and illustrative examples that may be preferably used include silica sand, quartz, aluminum hydroxide and a mixture thereof.

The slurry preferably has a specific gravity of 1.05 to 1.3. Use may be made of a technique that involves spraying of the slurry, a technique that involves the use of a wire brush, or a technique in which the surface shape of a textured mill roll is transferred to the aluminum plate.

The aqueous alkali solution that may be used in chemical etching treatment in the aqueous alkali solution has a concentration of preferably 1 to 30 wt % and may contain aluminum and alloying ingredients present in the aluminum alloy in an amount of 0 to 10 wt %.

An aqueous solution composed mainly of sodium hydroxide is preferably used for the aqueous alkali solution. Chemical etching treatment is preferably carried out at a solution temperature ranging from room temperature to 95° C. for a period of 1 to 120 seconds.

After the end of etching treatment, removal of the treatment solution with nip rollers and rinsing by spraying with water are preferably carried out in order to prevent the treatment solution from being carried into the subsequent step.

In the first alkali etching treatment, the aluminum plate is dissolved in an amount of preferably 0.5 to 30 $g/m^2$, more preferably 1.0 to 20 $g/m^2$, and even more preferably 3.0 to 15 $g/m^2$.

In the second alkali etching treatment, the aluminum plate is dissolved in an amount of preferably 0.001 to 30 $g/m^2$, more preferably 0.1 to 4 $g/m^2$, and even more preferably 0.2 to 1.5 $g/m^2$.

In the third alkali etching treatment, the aluminum plate is dissolved in an amount of preferably 0.001 to 30 $g/m^2$, more preferably 0.01 to 0.8 $g/m^2$, and even more preferably 0.02 to 0.3 $g/m^2$.

In chemical etching treatment in an aqueous acid solution (first to third desmutting treatments), phosphoric acid, nitric acid, sulfuric acid, chromic acid, hydrochloric acid or a mixed acid containing two or more thereof is advantageously used.

The aqueous acid solution preferably has a concentration of 0.5 to 60 wt %.

Aluminum and alloying ingredients present in the aluminum alloy may dissolve in the aqueous acid solution in an amount of 0 to 5 wt %.

Chemical etching treatment is preferably carried out at a solution temperature of room temperature to 95° C. for a treatment time of 1 to 120 seconds. After the end of desmutting treatment, removal of the treatment solution with nip rollers and rinsing by spraying with water are preferably carried out in order to prevent the treatment solution from being carried into the subsequent step.

The aqueous solution that may be used in electrochemical graining treatment is now described.

An aqueous solution which is used in conventional electrochemical graining treatment involving the use of direct current or alternating current may be employed for the nitric acid-based aqueous solution used in the first electrochemical graining treatment. The aqueous solution to be used may be prepared by adding to an aqueous solution having a nitric acid concentration of 1 to 100 g/L at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silicon may also be dissolved in the nitric acid-based aqueous solution.

More specifically, use is preferably made of a solution to which aluminum chloride or aluminum nitrate is added so that a 0.5 to 2 wt % aqueous solution of nitric acid may contain 3 to 50 g/L of aluminum ions.

The temperature is preferably from 10 to 90° C. and more preferably from 40 to 80° C.

An aqueous solution which is used in conventional electrochemical graining treatment involving the use of direct current or alternating current may be employed for the hydrochloric acid-based aqueous solution used in the second electrochemical graining treatment. The aqueous solution to be used may be prepared by adding to an aqueous solution having a hydrochloric acid concentration of 1 to 100 g/L at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silicon may also be dissolved in the hydrochloric acid-based aqueous solution.

More specifically, use is preferably made of a solution to which aluminum chloride or aluminum nitrate is added so that a 0.5 to 2 wt % aqueous solution of hydrochloric acid may contain 3 to 50 g/L of aluminum ions.

The temperature is preferably from 10 to 60° C. and more preferably from 20 to 50° C. Hypochlorous acid may be added to the aqueous solution.

On the other hand, an aqueous solution which is used in conventional electrochemical graining treatment involving the use of direct current or alternating current may be employed for the hydrochloric acid-based aqueous solution used in electrochemical graining treatment in the aqueous hydrochloric acid solution in Embodiment B. The aqueous solution to be used may be prepared by adding 0 to 30 g/L of sulfuric acid to an aqueous solution having a hydrochloric acid concentration of 1 to 100 g/L. The aqueous solution may be prepared by adding to this solution at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silicon may also be dissolved in the hydrochloric acid-based aqueous solution.

More specifically, use is preferably made of a solution to which aluminum chloride or aluminum nitrate is added so that a 0.5 to 2 wt % aqueous solution of nitric acid may contain 3 to 50 g/L of aluminum ions.

The temperature is preferably from 10 to 60° C. and more preferably from 20 to 50° C. Hypochlorous acid may be added to the aqueous solution.

A sinusoidal, square, trapezoidal or triangular waveform may be used as an AC power source waveform for electrochemical graining treatment. The frequency is preferably from 0.1 to 250 Hz.

Figure 4:
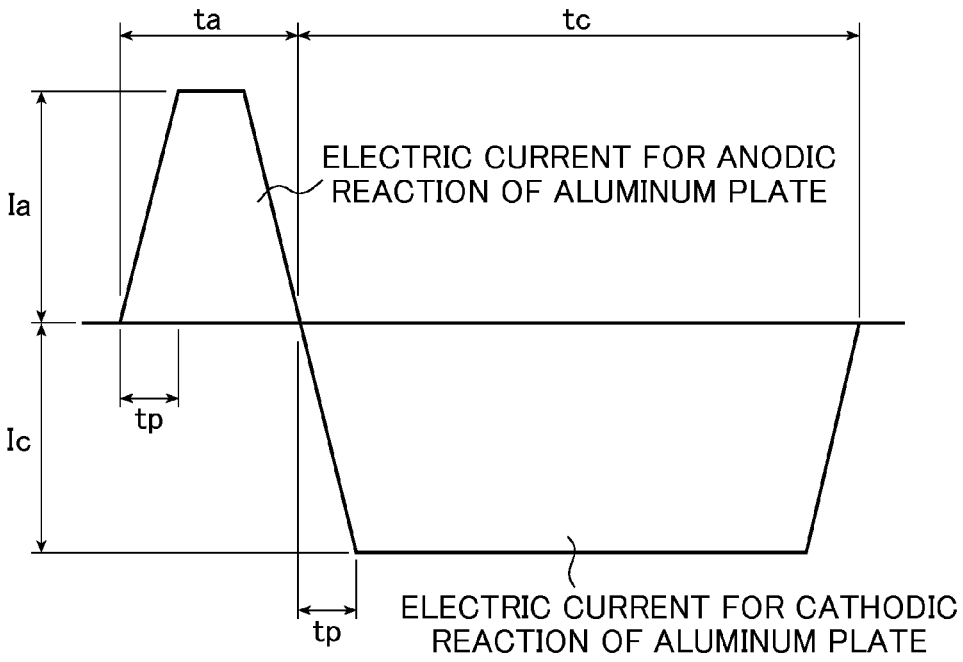
FIG. 4 is a graph showing an example of an alternating current waveform that may be used in electrochemical graining treatment in the method of manufacturing the lithographic printing plate support of the invention.

FIG. 4 is a graph showing an example of an alternating current waveform that may be used to perform electrochemical graining treatment in the method of manufacturing the lithographic printing plate support of the invention.

In FIG. 4, "ta" represents the anodic reaction time, "tc" the cathodic reaction time, "tp" the time required for the current to reach a peak from zero, "Ia" the peak current on the anode cycle side, and "Ic" the peak current on the cathode cycle side. In the trapezoidal waveform, it is preferable for the time tp until the current reaches a peak from zero to be from 1 to 10 ms. Under the influence of impedance in the power source circuit, at a time tp of less than 1 ms, a large power source voltage is required at the leading edge of the current waveform, thus increasing the power source equipment costs. At a time tp of more than 10 ms, the treatment tends to be affected by trace ingredients in the electrolytic solution, making it difficult to carry out uniform graining. One cycle of alternating current that may be used in electrochemical graining treatment preferably satisfies the following conditions: the ratio of the cathodic reaction time tc to the anodic reaction time ta in the aluminum plate (tc/ta) is from 1 to 20; the ratio of the amount of electricity Qc when the aluminum plate serves as a cathode to the amount of electricity Qa when it serves as an anode (Qc/Qa) is from 0.3 to 20; and the anodic reaction time ta is from 5 to 1,000 ms. The ratio tc/ta is more preferably from 2.5 to 15. The ratio Qc/Qa is more preferably from 2.5 to 15. The current density as a peak value in the trapezoidal waveform is preferably from 10 to 200 A/dm2 for both of the anode cycle side value Ia and the cathode cycle side value Ic. The ratio Ic/Ia is preferably in a range of 0.3 to 20. The total amount of electricity furnished for the anodic reaction of the aluminum plate up until completion of electrochemical graining treatment is preferably from 25 to 1,000 $C/dm^2$.

In the practice of the invention, any known electrolytic cell employed for surface treatment, including vertical, flat and radial type electrolytic cells, may be used to perform electrochemical graining treatment using alternating current. A radial type electrolytic cell such as the one described in JP 5-195300 A is especially preferred.

Figure 5:
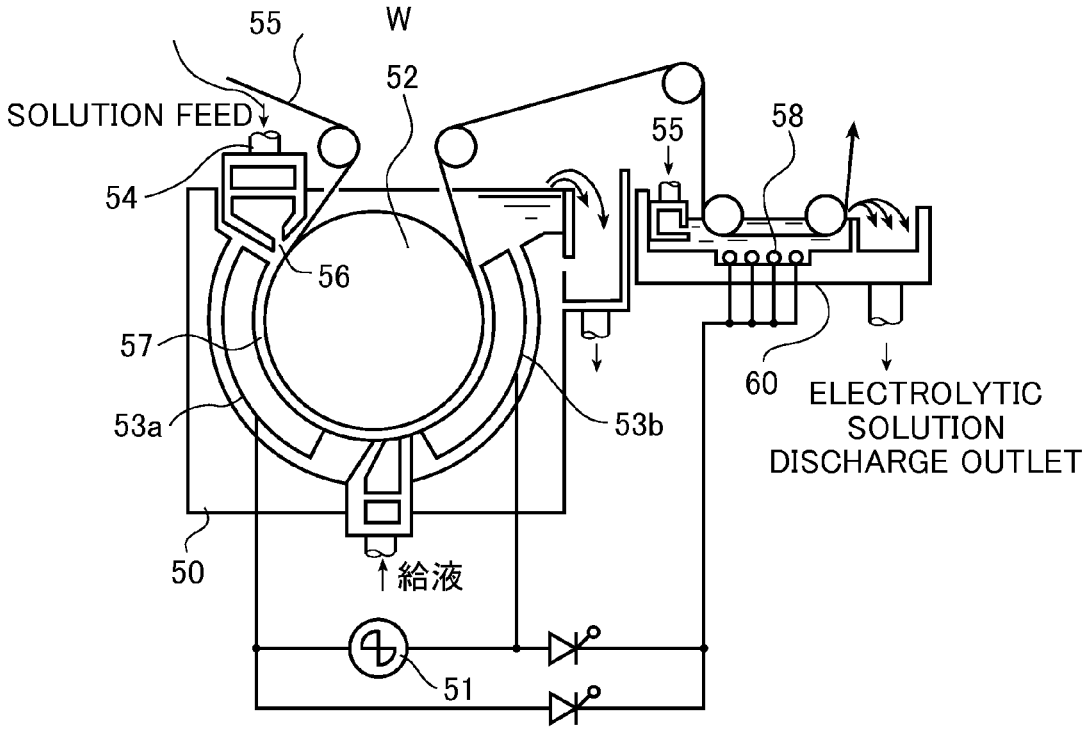
FIG. 5 is a side view showing an example of a radial cell in electrochemical graining treatment with alternating current in the method of manufacturing the lithographic printing plate support of the invention.

An apparatus shown in FIG. 5 may be used for electrochemical graining treatment using alternating current.

FIG. 5 is a side view of a radial electrolytic cell that may be used in electrochemical graining treatment with alternating current in the method of manufacturing the lithographic printing plate support of the invention.

FIG. 5 shows a main electrolytic cell 50, an AC power source 51, a radial drum roller 52, main electrodes 53*a* and 53*b*, a solution feed inlet 54, an electrolytic solution 55, a slit 56, an electrolytic solution channel 57, auxiliary anodes 58, an auxiliary anode cell 60 and an aluminum plate W. When two or more electrolytic cells are used, electrolysis may be performed under the same or different conditions.

The aluminum plate W is wound around the radial drum roller 52 disposed to be immersed in the electrolytic solution within the main electrolytic cell 50 and is electrolyzed by the main electrodes 53*a* and 53*b* connected to the AC power source 51 as it travels. The electrolytic solution 55 is fed from the solution feed inlet 54 through the slit 56 to the electrolytic solution channel 57 between the radial drum roller 52 and the main electrodes 53*a* and 53*b*. The aluminum plate W treated in the main electrolytic cell 50 is then electrolyzed in the auxiliary anode cell 60. In the auxiliary anode cell 60, the auxiliary anodes 58 are disposed in a face-to-face relationship with the aluminum plate W so that the electrolytic solution 55 flows through the space between the auxiliary anodes 58 and the aluminum plate W.

On the other hand, electrochemical graining treatments (first and second electrochemical graining treatments) may be performed by a method in which the aluminum plate is electrochemically grained by applying direct current between the aluminum plate and the electrodes opposed thereto.

<Drying Step>

After the lithographic printing plate support is obtained by the above-described steps, a treatment for drying the surface of the lithographic printing plate support (drying step) is preferably performed before providing an image recording layer to be described later thereon.

Drying is preferably performed after the support having undergone the last surface treatment is rinsed with water and the water is removed with nip rollers. Specific conditions are not particularly limited but the surface of the lithographic printing plate support is preferably dried by hot air (50 to 200° C.) or natural air.

<Lithographic Printing Plate Precursor>

The lithographic printing plate precursor of the invention can be obtained by forming an image recording layer such as a photosensitive layer or a thermosensitive layer exemplified below on the lithographic printing plate support of the invention. The type of the image recording layer is not particularly limited but conventional positive type, conventional negative type, photopolymer type (photopolymer-type photosensitive composition), thermal positive type, thermal negative type and on-press developable non-treatment type as described in paragraphs [0042] to [0198] of JP 2003-1956 A are preferably used.

A preferred image recording layer is described below in detail.

<Image Recording Layer>

An example of the image recording layer that may be preferably used in the lithographic printing plate precursor of the invention includes one which can be removed by printing ink and/or fountain solution. More specifically, the image recording layer is preferably one which includes an infrared absorber, a polymerization initiator and a polymerizable compound and is capable of recording by exposure to infrared light. Alternatively, the image recording layer may be one which includes thermoplastic polymer particles and an infrared absorber and is capable of recording by exposure to infrared light, or may also include a polyglycerol compound.

In the lithographic printing plate precursor of the invention, irradiation with infrared light cures exposed portions of the image recording layer to form hydrophobic (lipophilic) regions, while at the start of printing, unexposed portions are promptly removed from the support by fountain solution, ink, or an emulsion of ink and fountain solution.

The constituents of the image recording layer are described below.

(First Configuration: Image Recording Layer Including Infrared Absorber, Polymerization Initiator and Polymerizable Compound and Capable of Recording by Exposure to Infrared Light)

(Infrared Absorber)

In cases where an image is formed on the lithographic printing plate precursor of the invention using a laser emitting infrared light at 760 to 1,200 nm as a light source, an infrared absorber is usually used.

The infrared absorber has the function of converting absorbed infrared light into heat and, as being excited by the infrared light, performing electron transfer/energy transfer to the polymerization initiator (radical generator) to be described below.

The infrared absorber that may be used in the invention is a dye or pigment having an absorption maximum in a wavelength range of 760 to 1200 nm.

Dyes which may be used include commercial dyes and known dyes that are mentioned in the technical literature, such as "Senryo Binran" [Handbook of Dyes] (The Society of Synthetic Organic Chemistry, Japan, 1970).

Illustrative examples of suitable dyes include azo dyes, metal complex azo dyes, pyrazolone azo dyes, naphthoquinone dyes, anthraquinone dyes, phthalocyanine dyes, carbonium dyes, quinoneimine dyes, methine dyes, cyanine dyes, squarylium dyes, pyrylium salts and metal-thiolate complexes. For example, dyes disclosed in paragraphs [0096] to [0107] of JP 2009-255434 A can be advantageously used.

On the other hand, pigments described, for example, in paragraphs [0108] to [0112] of JP 2009-255434 A may be used.

(Polymerization Initiator)

Exemplary polymerization initiators which may be used are compounds that generate a radical under light or heat energy or both, and initiate or promote the polymerization of a compound having a polymerizable unsaturated group. In the invention, compounds that generate a radical under the action of heat (thermal radical generators) are preferably used.

Known thermal polymerization initiators, compounds having a bond with small bond dissociation energy and photopolymerization initiators may be used as the polymerization initiator.

For example, polymerization initiators described in paragraphs [0115] to [0141] of JP 2009-255434 A may be used.

Onium salts may be used as the polymerization initiator, and oxime ester compounds, diazonium salts, iodonium salts and sulfonium salts are preferred in terms of reactivity and stability.

These polymerization initiators may be added in an amount of 0.1 to 50 wt %, preferably 0.5 to 30 wt % and most preferably 1 to 20 wt % with respect to the total solids making up the image recording layer. An excellent sensitivity and high resistance to scumming in non-image areas during printing are achieved at a polymerization initiator content within the above-defined range.

(Polymerizable Compound)

Polymerizable compounds are addition polymerizable compounds having at least one ethylenically unsaturated double bond, and are selected from compounds having at least one, and preferably two or more, terminal ethylenically unsaturated bonds. In the invention, use can be made of any addition polymerizable compound known in the prior art, without particular limitation.

For example, polymerizable compounds described in paragraphs [0142] to [0163] of JP 2009-255434 A may be used.

Urethane typed addition polymerizable compounds produced using an addition reaction between an isocyanate group and a hydroxyl group are also suitable. Specific examples include the vinylurethane compounds having two or more polymerizable vinyl groups in the molecule that are obtained by adding a hydroxyl group-bearing vinyl monomer of the general formula (A) below to the polyisocyanate compounds having two or more isocyanate groups in the molecule mentioned in JP 48-41708 B:

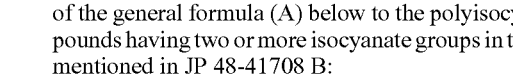

$$CH_2{=}C(R^4)COOCH_2CH(R^5)OH \quad (A)$$

(wherein $R^4$ and $R^5$ are H or $CH_3$).

The polymerizable compound is used in an amount of preferably 5 to 80 wt %, and more preferably 25 to 75 wt % with respect to the nonvolatile ingredients in the image recording layer. These addition polymerizable compounds may be used alone or in combination of two or more thereof.

(Binder Polymer)

In the practice of the invention, use may be made of a binder polymer in the image recording layer in order to improve the film forming properties of the image recording layer.

Conventionally known binder polymers may be used without any particular limitation and polymers having film forming properties are preferred. Examples of such binder polymers include acrylic resins, polyvinyl acetal resins, polyurethane resins, polyurea resins, polyimide resins, polyamide resins, epoxy resins, methacrylic resins, polystyrene resins, novolac-type phenolic resins, polyester resins, synthetic rubbers and natural rubbers.

Crosslinkability may be imparted to the binder polymer to enhance the film strength in image areas. To impart crosslinkability to the binder polymer, a crosslinkable functional group such as an ethylenically unsaturated bond may be introduced into the polymer main chain or side chain. The crosslinkable functional groups may be introduced by copolymerization.

Binder polymers disclosed in paragraphs [0165] to [0172] of JP 2009-255434 A may also be used.

The binder polymer content is from 5 to 90 wt %, preferably from 5 to 80 wt % and more preferably from 10 to 70 wt % based on the total solids in the image recording layer. A high strength in image areas and good image forming properties are achieved at a binder polymer content within the above-defined range.

The polymerizable compound and the binder polymer are preferably used at a weight ratio of 0.5/1 to 4/1.

(Surfactant)

A surfactant is preferably used in the image recording layer in order to promote the on-press developability at the start of printing and improve the coating surface state.

Exemplary surfactants include nonionic surfactants, anionic surfactants, cationic surfactants, amphoteric surfactants and fluorosurfactants.

For example, surfactants disclosed in paragraphs [0175] to [0179] of JP 2009-255434 A may be used.

Use may be made of a single surfactant or of a combination of two or more surfactants.

The surfactant content is preferably from 0.001 to 10 wt %, and more preferably from 0.01 to 5 wt % with respect to the total solids in the image recording layer.

Various other compounds than those mentioned above may optionally be added to the image recording layer. For example, compounds disclosed in paragraphs [0181] to [0190] of JP 2009-255434 A such as colorants, printing-out agents, polymerization inhibitors, higher fatty acid derivatives, plasticizers, inorganic fine particles and low-molecular-weight hydrophilic compounds may be used.

An embodiment other than that described above is also possible in which a photopolymer-type photosensitive composition containing an addition-polymerizable compound, a photopolymerization initiator and a polymer binder may be used to prepare the image recording layer.

Preferred addition-polymerizable compounds include compounds containing an ethylenically unsaturated bond which are addition-polymerizable. Ethylenically unsaturated bond-containing compounds are compounds which have a terminal ethylenically unsaturated bond.

The photopolymerization initiator may be any of various photopolymerization initiators or any system of two or more photopolymerization initiators (photoinitiation system) which is suitably selected according to the wavelength of the light source to be used.

(Second Configuration: Image Recording Layer Including Thermoplastic Polymer Particles and Infrared Absorber and Capable of Recording by Exposure to Infrared Light)

(Thermoplastic Polymer Particles)

The thermoplastic polymer particles have an average particle size of preferably 45 nm to 63 nm, more preferably 45 nm to 60 nm, still more preferably 45 nm to 59 nm, particularly preferably 45 nm to 55 nm and most preferably 48 nm to 52 nm. In the present description, the particle size is the particle diameter measured by photon correlation spectrometry which is also known as quasi-elastic light scattering or dynamic light scattering. This method is useful for measuring the particle size. Values of measured particle size match well with the particle size measured with transmission electronic microscopy (TEM) as disclosed by Stanley D. Duke et al. in "Calibration of Spherical Particles by Light Scattering" in Technical Note-002B, May 15, 2000 (revised on Jan. 3, 2000 from a paper published in Particulate Science and Technology 7, pp. 223-228 (1989)).

The amount of the thermoplastic polymer particles contained in the image recording layer is preferably from 70 wt % to 85 wt % and more preferably from 75 wt % to 85 wt %. The weight percentage of the thermoplastic polymer particles is determined with respect to the weight of all the ingredients in the image-recording layer.

Preferred examples of the thermoplastic polymer particles include polyethylene, poly(vinyl)chloride, polymethyl (meth)acrylate, polyethyl(meth)acrylate, polyvinylidene chloride, poly(meth)acrylonitrile, polyvinylcarbazole, polystyrene and copolymers thereof. According to a preferred embodiment, the thermoplastic polymer particles include polystyrene or a derivative thereof, a mixture of polystyrene and poly(meth)acrylonitrile or derivatives thereof, or a copolymer of polystyrene and poly(meth)acrylonitrile or derivatives thereof. The copolymer may include at least 50 wt % of polystyrene and more preferably at least 65 wt % of polystyrene. In order to obtain sufficient resistance to organic chemicals such as hydrocarbons, the thermoplastic polymer particles preferably comprise at least 5 wt % of nitrogen-containing units as described in EP 1219416, more preferably at least 30 wt % of nitrogen-containing units such as (meth) acrylonitrile. According to the most preferred embodiment, the thermoplastic polymer particles consist essentially of styrene and acrylonitrile units in a weight ratio between 1:1 and 5:1 (styrene:acrylonitrile), e.g., in a ratio of 2:1.

The thermoplastic polymer particles preferably have a weight-average molecular weight of 5,000 to 1,000,000 g/mol.

(Infrared Absorber)

The concentration of the infrared absorber in the image recording layer is preferably at least 6 wt %, more preferably at least 8 wt %, with respect to the weight of all the ingredients in the image-recording layer. Preferred IR absorbing compounds are dyes such as cyanine, merocyanine, indoaniline, oxonol, pyrilium, and squarilium dyes or pigments such as carbon black. Examples of suitable infrared absorbers are described in, for instance, EP 823327, EP 978376, EP 1029667, EP 1053868, EP 1093934, WO 97/39894 and WO 00/29214. Preferred compounds are the following cyanine dyes.

[Chemical Formula 1]

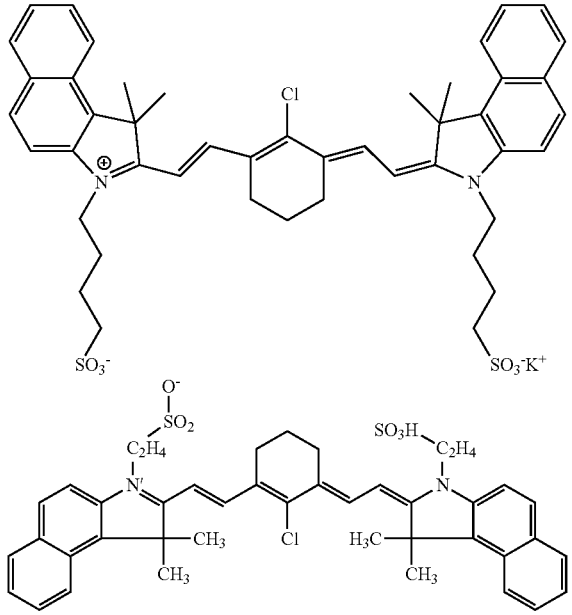

The image recording layer may further contain other ingredients. Exemplary ingredients include additional binders, polymer particles such as matting agents and spacers, surfactants such as perfluoro-surfactants, silicon or titanium dioxide particles, development inhibitors, development accelerators, colorants and other known ingredients. In particular, addition of colorants such as dyes or pigments which provide a visible color to the image recording layer and remain in exposed areas of the image recording layer after the processing step is advantageous. Thus, image areas which are not removed during the processing step form a visible image on the printing plate, and examination of the printing plate developed already at this stage becomes feasible. Typical examples of such contrast dyes are amino-substituted tri- or diarylmethane dyes, for instance, crystal violet, methyl violet, victoria pure blue, flexoblau 630, basonylblau 640, auramine, and malachite green. The dyes which are discussed in depth in the detailed description of EP 400706 are also suitable contrast dyes.

A hydrophilic resin may be added to the image recording layer to improve the on-press developability and the film strength of the image recording layer. A hydrophilic resin which is not three-dimensionally crosslinked is preferred in terms of on-press developability.

Preferred hydrophilic resins include those having hydrophilic groups such as hydroxyl, carboxyl, hydroxyethyl, hydroxypropyl, amino, aminoethyl, aminopropyl and carboxymethyl groups.

Specific examples of the hydrophilic resin include gum arabic, casein, gelatin, soya gum, starch and its derivatives, cellulose derivatives such as hydroxyethyl cellulose, hydroxypropyl cellulose, methyl cellulose, carboxymethyl cellulose and their salts and cellulose acetate, alginic acid and their alkali metal salts, alkaline earth metal salts or ammonium salts, water-soluble urethane resins, water-soluble polyester resins, vinyl acetate-maleic acid copolymers, styrene-maleic acid copolymers, polyacrylic acids and their salts, polymethacrylic acids and their salts, homopolymers and copolymers of hydroxyethyl methacrylate, homopolymers and copolymers of hydroxyethyl acrylate, homopolymers and copolymers of hydroxypropyl methacrylate, homopolymers and copolymers of hydroxypropyl acrylate, homopolymers and copolymers of hydroxybutyl methacrylate, homopolymers and copolymers of hydroxybutyl acrylate, polyethylene oxides, poly(propylene oxides), polyvinyl alcohols (PVAs), hydrolyzed polyvinyl acetates having a degree of hydrolysis of at least 60% and preferably at least 80%, polyvinyl formal, polyvinyl butyral, polyvinyl pyrrolidone, acrylamide homopolymers and copolymers, methacrylamide homopolymers and copolymers, N-methylolacrylamide homopolymers and copolymers, and 2-acrylamide-2-methylpropanesulfonic acid and their salts.

The hydrophilic resin is preferably added to the image recording layer in an amount of 2 to 40 wt % and more preferably 3 to 30 wt % of the solids in the image recording layer. Excellent on-press developability and a long press life are achieved when the amount of addition is within this range.

A surfactant such as a fluorosurfactant as described in JP 62-170950 A may be added to the image recording layer-forming coating liquid in order to enhance the coating properties and have a good coating surface. The amount of addition is preferably from 0.01 to 1 wt % of the solids of the image recording layer.

The image recording layer containing the above-described ingredients can be imagewise exposed directly by heat, e.g., by a thermal head or indirectly by infrared light, preferably near infrared light. Infrared light is converted into heat by the infrared absorber as described above. The thermosensitive lithographic printing plate precursor used in the invention is preferably not sensitive to visible light. Most preferably, the image recording layer is not sensitive to ambient daylight, i.e., visible light (400 to 750 nm) and near UV light (300 to 400 nm) at an intensity and exposure time corresponding to normal working conditions so that the materials are handled without the need for safe light environment.

<Formation of Image Recording Layer>

The image recording layer is formed by dispersing or dissolving the necessary ingredients described above in a solvent to prepare a coating liquid and applying the thus prepared coating liquid to the support. Examples of the solvent that may be used include, but are not limited to, ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate and water.

These solvents may be used alone or as mixtures of two or more thereof. The coating liquid has a solids concentration of preferably 1 to 50 wt %.

The image recording layer coating weight (in terms of solids) on the lithographic printing plate support obtained after coating and drying varies depending on the intended application, although an amount of 0.3 to 3.0 g/m$^2$ is generally preferred. At an image recording layer coating weight within this range, a good sensitivity and good image recording layer film properties are obtained.

Examples of suitable methods of coating include bar coating, spin coating, spray coating, curtain coating, dip coating, air knife coating, blade coating and roll coating.

<Undercoat Layer>

In the lithographic printing plate precursor of the invention, it is desirable to provide an undercoat layer between the image recording layer and the lithographic printing plate support.

The undercoat layer preferably contains a polymer having a substrate adsorbable group, a polymerizable group and a hydrophilic group.

An example of the polymer having a substrate adsorbable group, a polymerizable group and a hydrophilic group includes an undercoating polymer resin obtained by copolymerizing an adsorbable group-bearing monomer, a hydrophilic group-bearing monomer and a polymerizable reactive group (crosslinkable group)-bearing monomer.

Monomers described in paragraphs [0197] to [0210] of JP 2009-255434 A, for example, may be used for the undercoating polymer resin.

An embodiment in which the surface of the support is subjected to a predetermined treatment to form the undercoat layer (particularly, a hydrophilic undercoat layer) is also preferred.

For example, the aluminum oxide surface may be silicated by treating the surface with a sodium silicate solution at a high temperature of, for instance, 95° C. Alternatively, a phosphate treatment may be applied which involves treating the aluminum oxide surface with a phosphate solution that may further contain an inorganic fluoride. Further, the aluminum oxide surface may be rinsed with an organic acid and/or salt thereof, e.g., carboxylic acids, hydrocarboxylic acids, sulphonic acids or phosphonic acids, or their salts, e.g., succinates, phosphates, phosphonates, sulphates and sulphonates. Citric acid or a citrate is preferred. This treatment may be carried out at room temperature or at a slightly high temperature of about 30° C. to about 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulfonic acid, polyvinylbenzenesulfonic acid, sulfuric acid esters of polyvinyl alcohol, and acetals of polyvinyl alcohols formed by reaction with a sulfonated aliphatic aldehyde. It is further evident that one or more of these post treatments may be carried out alone or in combination. More detailed descriptions of these treatments are given in GB 1084070, DE 4423140, DE 4417907, EP 659909, EP 537633, DE 4001466, EP 292801, EP 291760 and U.S. Pat. No. 4,458,005.

Another embodiment of the undercoat layer includes a crosslinked hydrophilic layer obtained from a hydrophilic binder crosslinked with a hardening agent such as formaldehyde, glyoxal, polyisocyanate, or a hydrolyzed tetra-alkylorthosilicate. The thickness of the crosslinked hydrophilic layer may vary in the range of 0.2 to 25 μm and is preferably 1 to 10 μm. The hydrophilic binder for use in the crosslinked hydrophilic layer is, for example, a hydrophilic (co)polymer such as homopolymers and copolymers of vinyl alcohol, acrylamide, methylol acrylamide, methylol methacrylamide, acrylate acid, methacrylate acid, hydroxyethyl acrylate and hydroxyethyl methacrylate, or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60 wt %, preferably 80 wt %. The amount of hardening agent, in particular tetra-alkyl orthosilicate, is preferably at least 0.2 parts by weight, more preferably 0.5 to 5 parts by weight, and most preferably 1 to 3 parts by weight, per part by weight of the hydrophilic binder.

Various known methods may be used to apply the undercoat layer-forming coating liquid containing the constituents of the undercoat layer to the support. Examples of suitable methods of application include bar coating, spin coating, spray coating, curtain coating, dip coating, air knife coating, blade coating and roll coating.

The coating weight (solids) of the undercoat layer is preferably from 0.1 to 100 mg/m$^2$ and more preferably from 1 to 50 mg/m$^2$.

<Protective Layer>

In the lithographic printing plate precursor of the invention, the image recording layer may optionally have a protective layer formed thereon to prevent scuffing and other damage to the image recording layer, to serve as an oxygen barrier, and to prevent ablation during exposure with a high-intensity laser.

The protective layer has heretofore been variously studied and is described in detail in, for example, U.S. Pat. No. 3,458,311 and JP 55-49729 B.

Exemplary materials that may be used for the protective layer include those described, for example, in paragraphs [0213] to [0227] of JP 2009-255434 A (e.g., water-soluble polymer compounds and inorganic layered compounds).

The thus prepared protective layer-forming coating liquid is applied onto the image recording layer provided on the support and dried to form the protective layer. The coating solvent may be selected as appropriate in connection with the binder, but distilled water and purified water are preferably used in cases where a water-soluble polymer is employed. Examples of the coating method used to form the protective layer include, but are not limited to, blade coating, air knife coating, gravure coating, roll coating, spray coating, dip coating and bar coating.

The coating weight after drying of the protective layer is preferably from 0.01 to 10 g/m$^2$, more preferably from 0.02 to 3 g/m$^2$, and most preferably from 0.02 to 1 g/m$^2$.

The lithographic printing plate precursor of the invention which has the image recording layer as described above exhibits excellent deinking ability after suspended printing, a long press life, excellent resistance to dotted scumming and excellent resistance to white spot formation in the lithographic printing plate formed therefrom and exhibits improved on-press developability in the case of an on-press development type.

EXAMPLES

Example A

Manufacture of Lithographic Printing Plate Support

Aluminum alloy plates of the composition shown in Table A with a thickness of 0.3 mm were subjected to the treatments (a) to (n) described below to manufacture lithographic printing plate supports. Rinsing treatment was performed between every two treatment steps and the water remaining after rinsing treatment was removed with nip rollers.

Table A discloses the composition of the aluminum alloy plates used in Examples 1 to 30 and Comparative Examples 1 to 22 to be described later. In Table A, the values in columns of ingredients are given in weight percent, with the balance being A1.

TABLE A

| | Composition (wt %) | | | | | | | |
|---|---|---|---|---|---|---|---|---|
| | Si | Fe | Cu | Mn | Mg | Zn | Ti | Al |
| Examples 1 to 30 and Comparative Examples 1 to 22 | 0.085 | 0.303 | 0.037 | 0 | 0 | 0 | 0.018 | Balance |

(a) Mechanical Graining Treatment (Brush Graining)

Figure 6:
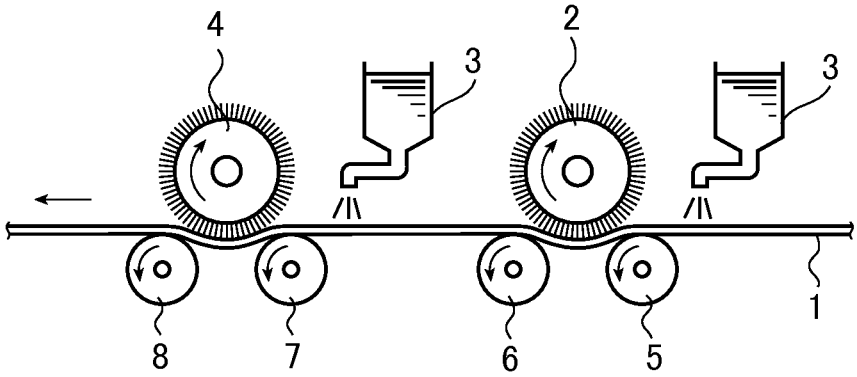
FIG. 6 is a side view conceptually showing a brush graining step used in mechanical graining treatment during the manufacture of the lithographic printing plate support of the invention.

Mechanical graining treatment was performed with rotating bristle bundle brushes of an apparatus as shown in FIG. 6 while feeding an abrasive slurry in the form of a suspension of pumice (specific gravity, 1.1 g/cm$^3$) to the surface of the aluminum plate. FIG. 6 shows an aluminum plate 1, roller-type brushes (bristle bundle brushes in Examples) 2 and 4, an abrasive slurry 3, and support rollers 5, 6, 7 and 8.

Mechanical graining treatment was carried out using an abrasive having a median diameter of 30 μm with four brushes rotating at 250 rpm. The bristle bundle brushes were made of nylon 6/10 and had a bristle diameter of 0.3 mm and a bristle length of 50 mm. Each brush was constructed of a 300 mm diameter stainless steel cylinder in which holes had been formed and bristles densely set. Two support rollers (200 mm diameter) were provided below each bristle bundle brush and spaced 300 mm apart. The bundle bristle brushes were pressed against the aluminum plate until the load on the driving motor that rotates the brushes was greater by 10 kW than before the bundle bristle brushes were pressed against the plate. The direction in which the brushes were rotated was the same as the direction in which the aluminum plate was moved.

(b) Alkali Etching Treatment

Etching treatment was performed by using a spray line to spray the aluminum plate obtained as described above with an aqueous solution having a sodium hydroxide concentration of 26 wt %, an aluminum ion concentration of 6.5 wt %, and a temperature of 70° C. The plate was then rinsed by spraying with water. The amount of dissolved aluminum was 10 g/m$^2$.

(c) Desmutting Treatment in Aqueous Acid Solution

Next, desmutting treatment was performed in an aqueous nitric acid solution. The nitric acid used in the subsequent electrochemical graining treatment step was used for the aqueous nitric acid solution in desmutting treatment. The solution temperature was 35° C. Desmutting treatment was performed by spraying the plate with the desmutting solution for 3 seconds.

(d) Electrochemical Graining Treatment

Electrochemical graining treatment was consecutively carried out by nitric acid electrolysis using a 60 Hz AC voltage. Aluminum nitrate was added to an aqueous solution containing 10.4 g/L of nitric acid at a temperature of 35° C. to prepare an electrolytic solution having an adjusted aluminum ion concentration of 4.5 g/L, and the electrolytic solution was used in electrochemical graining treatment. The AC power source waveform was as shown in FIG. 4 and electrochemical graining treatment was performed using an alternating current of a trapezoidal waveform with a time tp until the current reached a peak from zero of 0.8 ms and a duty ratio of 1:1, and using a carbon electrode as the counter electrode. Ferrite was used for the auxiliary anodes. An electrolytic cell of the type shown in FIG. 5 was used. The current density as a peak current value was 30 A/dm$^2$. Of the current that flows from the power source, 5% was diverted to the auxiliary anodes. The amount of electricity (C/dm$^2$), as the total amount of electricity when the aluminum plate serves as an anode, was 185 C/dm$^2$. The substrate was then rinsed by spraying with water.

(e) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.5 g/m$^2$.

(f) Desmutting Treatment in Aqueous Acid Solution

Next, desmutting treatment was performed in an aqueous sulfuric acid solution. The aqueous sulfuric acid solution used in desmutting treatment was a solution having a sulfuric acid concentration of 170 g/L and an aluminum ion concentration of 5 g/L. The solution temperature was 60° C. Desmutting treatment was performed by spraying the plate with the desmutting solution for 3 seconds.

(g) Electrochemical Graining Treatment

Electrochemical graining treatment was consecutively carried out by hydrochloric acid electrolysis using a 60 Hz AC voltage. Aluminum chloride was added to an aqueous solution containing 6.2 g/L of hydrochloric acid at a temperature of 35° C. to prepare an electrolytic solution having an adjusted aluminum ion concentration of 4.5 g/L, and the electrolytic solution was used in electrochemical graining treatment. The AC power source waveform was as shown in FIG. 4 and electrochemical graining treatment was performed using an alternating current of a trapezoidal waveform with a time tp until the current reached a peak from zero of 0.8 ms and a duty ratio of 1:1, and using a carbon electrode as the counter electrode. A ferrite was used for the auxiliary anode. An electrolytic cell of the type shown in FIG. 5 was used. The current density at the current peak was 25 A/dm$^2$. The amount of electricity (C/dm$^2$) in hydrochloric acid electrolysis, which is the total amount of electricity when the aluminum plate serves as an anode, was 63 C/dm$^2$. The substrate was then rinsed by spraying with water.

(h) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.1 g/m$^2$.

(i) Desmutting Treatment in Aqueous Acid Solution

Next, desmutting treatment was performed in an aqueous sulfuric acid solution. More specifically, an aqueous sulfuric acid solution for use in the anodizing treatment step (aqueous solution containing 170 g/L of sulfuric acid and 5 g/L of aluminum ions dissolved therein) was used to perform desmutting treatment at a solution temperature of 35° C. for 4 seconds. Desmutting treatment was performed by spraying the plate with the desmutting solution for 3 seconds.

(j) First Anodizing Treatment

Figure 7:
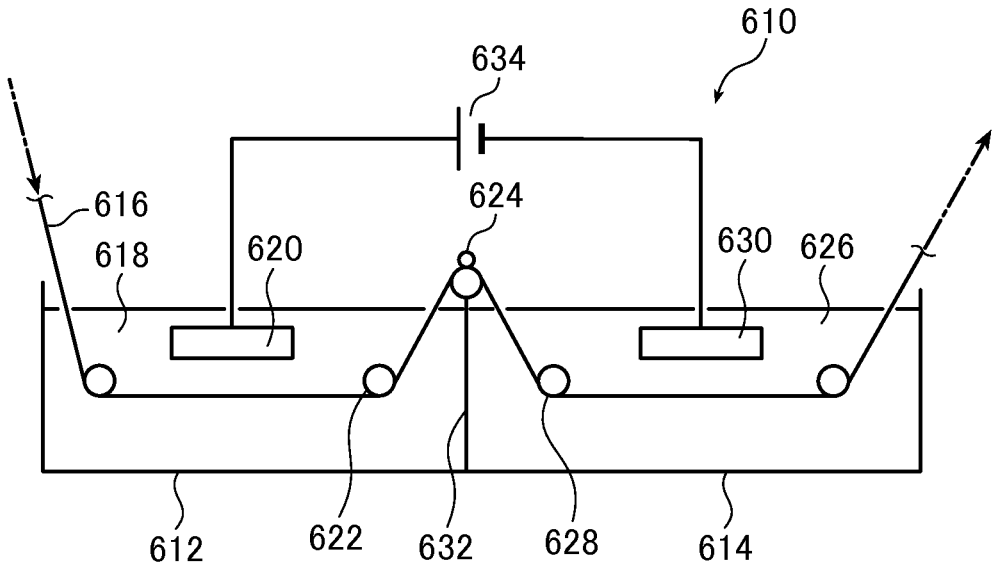
FIG. 7 is a schematic view of an anodizing apparatus that may be used in anodizing treatment during the manufacture of the lithographic printing plate support of the invention.

The first anodizing treatment was performed by DC electrolysis using an anodizing apparatus of the structure as shown in FIG. 7. The anodizing treatment was performed under the conditions shown in Table 1 to form the anodized film with a specified film thickness. The electrolytic solution used is an aqueous solution containing the ingredients shown in Table 1.

In an anodizing apparatus 610, an aluminum plate 616 is transported as shown by arrows in FIG. 7. The aluminum plate 616 is positively (+) charged by a power supply electrode 620 in a power supply cell 612 containing an electrolytic solution 618. The aluminum plate 616 is then transported upward by a roller 622 disposed in the power supply cell 612, turned downward by nip rollers 624 and transported toward an electrolytic cell 614 containing an electrolytic solution 626 to be turned to a horizontal direction by a roller 628. Then, the aluminum plate 616 is negatively (−) charged by an electrolytic electrode 630 to form an anodized film on the plate surface. The aluminum plate 616 emerging from the electrolytic cell 614 is then transported to the section for the subsequent step. In the anodizing apparatus 610, the roller 622, the nip rollers 624 and the roller 628 constitute direction changing means, and the aluminum plate 616 is transported from the power supply cell 612 to the electrolytic cell 614 in a mountain shape and a reversed U shape by means of these rollers 622, 624 and 628. The power supply electrode 620 and the electrolytic electrode 630 are connected to a DC power source 634.

(k) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 1. The substrate was then rinsed by spraying with water.

(l) Second Anodizing Treatment

The second anodizing treatment was performed by DC electrolysis using an anodizing apparatus of the structure as shown in FIG. 7. The anodizing treatment was performed under the conditions shown in Table 1 to form the anodized film with a specified film thickness.

The electrolytic solution used is an aqueous solution containing the ingredients shown in Table 1.

(m) Third Anodizing Treatment

The third anodizing treatment was performed by DC electrolysis using an anodizing apparatus of the structure as shown in FIG. 7. The anodizing treatment was performed under the conditions shown in Table 1 to form the anodized film with a specified film thickness.

The electrolytic solution used is an aqueous solution containing the ingredients shown in Table 1.

(n) In order to ensure the hydrophilicity in non-image areas, silicate treatment was performed by dipping the plate into an aqueous solution containing 2.5 wt % of No. 3 sodium silicate at 50° C. for 7 seconds. The amount of deposited silicon was 8.5 mg/m$^2$. The substrate was then rinsed by spraying with water.

The average diameter at the anodized film surface of the large-diameter portions in the micropore-bearing anodized film obtained after the second anodizing treatment step (or the third anodizing treatment step) (surface layer average diameter), the average diameter of the large-diameter portions at the communication level (bottom average diameter), the average diameter of the small-diameter portions at the communication level (small-diameter portion diameter), the average depths of the large-diameter portions and small-diameter portions, the thickness of the anodized film between the bottoms of the small-diameter portions and the surface of the aluminum plate (barrier layer thickness), the shapes of the large-diameter portions and small-diameter portions, the density of the small-diameter portions and the ratio (small-diameter portion diameter/large-diameter portion diameter) are all shown in Table 2.

For the barrier layer thickness, the average and the minimum value are shown. The average was obtained by measuring the thickness of the anodized film between the bottoms of the small-diameter portions and the surface of the aluminum plate and calculating the arithmetic mean of the measurements. In Examples 13 to 15 and 26 to 30, the average was obtained by measuring the thickness of the anodized film between the bottoms of the first small-diameter portions and the surface of the aluminum plate at 50 places and calculating the arithmetic mean of the measurements.

The average diameters of the micropores (average diameter of the large-diameter portions and that of the small-diameter portions) were determined as follows: The anodized film showing the aperture surfaces of the large-diameter portions and those of the small-diameter portions was observed with FE-SEM at a magnification of 150,000× to obtain four images (N=4), in the resulting four images, the diameter of the micropores (large-diameter portions and small-diameter portions) was measured within an area of 400×600 nm$^2$ and the average of the measurements was calculated. When it was difficult to measure the diameter of the small-diameter portions because of the large depth of the large-diameter portions, the upper portion of the anodized film was cut out to determine the various diameters.

The average depth of the large-diameter portions was determined as follows: The cross-section of the support (anodized film) was observed with FE-TEM at a magnification of 500,000×, in the resulting image, the depth of arbitrarily selected 60 (N=60) micropores from the surface to the communication level was measured, and the average of the measurements was calculated. The average depth of the small-diameter portions was determined as follows: The cross-section of the support (anodized film) was observed with FE-SEM (at a magnification of 50,000×), in the resulting image, the depth of arbitrarily selected 25 micropores was measured, and the average of the measurements was calculated.

The electrolytic solution used in each step is an aqueous solution containing the ingredients shown in Table 1. In Table 1, hyphen (-) indicates that the treatment concerned was not performed. In Table 1, "Ingredient Conc." refers to a concentration (g/l) of each ingredient shown in the column of "Liquid ingredient."

In Table 2, "Communicating portion density" refers to a density of small-diameter portions in the cross section of the anodized film at the communication level. "Surface area increase rate" is a value obtained by Equation (A) described above.

In Examples 13 to 15 and 26 to 30, the column of "Average depth (nm)" of the small-diameter portions in Table 2 shows the average depth of the second small-diameter portions to the left and that of the first small-diameter portions to the right.

In Examples 13 to 15 and 26 to 30, the column of "Communicating portion density" of the small-diameter portions in Table 2 shows the density of the first small-diameter portions in parentheses together with the density of the small-diameter portions.

In Examples 13 to 15 and 26 to 30, the average diameter of the first small-diameter portions at a position between the bottoms of the second small-diameter portions and the bottoms of the first small-diameter portions was about 12 nm.

TABLE 1

| | First anodizing treatment | | | | | | | Pore-widening treatment | | | | | Second anodizing treatment |
|---|---|---|---|---|---|---|---|---|---|---|---|---|---|
| | Liquid type | Liquid ingredient | Ingredient Conc. (g/l) | Temp. (° C.) | Current density (A/dm$^2$) | Time (s) | Film thickness (nm) | Liquid type | Solution | Conc. (wt %) | Temp. (° C.) | Time (s) | Liquid type |
| EX 1 | Sulfuric acid | $H_2SO_4$/Al | 170/5 | 55 | 90 | 0.40 | 110 | — | — | — | — | — | Sulfuric acid |
| EX 2 | Sulfuric acid | $H_2SO_4$/Al | 170/5 | 55 | 90 | 0.31 | 85 | — | — | — | — | — | Sulfuric acid |
| EX 3 | Sulfuric acid | $H_2SO_4$/Al | 170/5 | 55 | 90 | 0.47 | 130 | — | — | — | — | — | Sulfuric acid |
| EX 4 | Sulfuric acid | $H_2SO_4$/Al | 150/5 | 55 | 90 | 0.40 | 110 | — | — | — | — | — | Sulfuric acid |
| EX 5 | Sulfuric acid | $H_2SO_4$/Al | 150/5 | 55 | 90 | 0.35 | 95 | — | — | — | — | — | Suifuric acid |
| EX 6 | Sulfuric acid | $H_2SO_4$/Al | 150/5 | 55 | 90 | 0.47 | 130 | — | — | — | — | — | Sulfuric acid |
| EX 7 | Sulfuric acid | $H_2SO_4$/Al | 170/5 | 32 | 90 | 0.27 | 75 | Sodium hydroxide | NaOH/Al | 5/0.5 | 35 | — | Sulfuric acid |
| EX 8 | Sulfuric acid | $H_2SO_4$/Al | 5/5 | 55 | 90 | 0.45 | 123 | — | — | — | — | — | Sulfuric acid |
| EX 9 | Sulfuric acid | $H_2SO_4$/Al | 170/5 | 32 | 90 | 1.09 | 125 | — | — | — | — | — | Sulfuric acid |
| EX 10 | Sulfuric acid | $H_2SO_4$/Al | 170/5 | 55 | 90 | 0.29 | 75 | — | — | — | — | — | Sulfuric acid |
| EX 11 | Sulfuric acid | $H_2SO_4$/Al | 170/5 | 55 | 90 | 0.29 | 80 | — | — | — | — | — | Sulfuric acid |
| EX 12 | Sulfuric acid | $H_2SO_4$/Al | 170/5 | 55 | 90 | 0.73 | 200 | — | — | — | — | — | Sulfuric acid |
| EX 13 | Phosphoric acid | $H_2SO_4$/Al | 170/5 | 55 | 90 | 0.29 | 80 | — | — | — | — | — | Sulfuric acid |
| EX 14 | Phosphoric acid | $H_2SO_4$/Al | 170/5 | 55 | 90 | 0.29 | 80 | — | — | — | — | — | Sulfuric acid |
| EX 15 | Sulfuric acid | $H_2SO_4$/Al | 170/5 | 55 | 90 | 0.40 | 110 | — | — | — | — | — | Sulfuric acid |
| EX 16 | Sulfuric acid | $H_2SO_4$/Al | 170/5 | 55 | 90 | 0.40 | 110 | — | — | — | — | — | Sulfuric acid |
| EX 17 | Sulfuric acid | $H_2SO_4$/Al | 170/5 | 55 | 90 | 0.40 | 110 | — | — | — | — | — | Sulfuric acid |
| EX 18 | Sulfuric acid | $H_2SO_4$/Al | 170/5 | 55 | 90 | 0.40 | 110 | — | — | — | — | — | Sulfuric acid |
| EX 19 | Sulfuric acid | $H_2SO_4$/Al | 170/5 | 55 | 90 | 0.40 | 110 | — | — | — | — | — | Sulfuric acid |
| EX 20 | Sulfuric acid | $H_2SO_4$/Al | 10/5 | 55 | 90 | 0.40 | 110 | — | — | — | — | — | Sulfuric acid |
| EX 21 | Sulfuric acid | $H_2SO_4$/Al | 80/5 | 55 | 90 | 0.40 | 110 | — | — | — | — | — | Sulfuric acid |
| EX 22 | Sulfuric acid | $H_2SO_4$/Al | 170/5 | 55 | 50 | 0.72 | 110 | — | — | — | — | — | Sulfuric acid |
| EX 23 | Sulfuric acid | $H_2SO_4$/Al | 170/5 | 55 | 20 | 1.80 | 110 | — | — | — | — | — | Sulfuric acid |
| EX 24 | Sulfuric acid | $H_2SO_4$/Al | 170/5 | 55 | 90 | 0.40 | 110 | — | — | — | — | — | Sulfuric acid |
| EX 25 | Sulfuric acid | $H_2SO_4$/Al | 170/5 | 55 | 90 | 0.40 | 110 | — | — | — | — | — | Sulfuric acid |
| EX 26 | Sulfuric acid | $H_2SO_4$/Al | 170/5 | 55 | 90 | 0.40 | 110 | — | — | — | — | — | Sulfuric acid |
| EX 27 | Sulfuric acid | $H_2SO_4$/Al | 170/5 | 55 | 90 | 0.29 | 80 | — | — | — | — | — | Sulfuric acid |
| EX 28 | Sulfuric acid | $H_2SO_4$/Al | 170/5 | 55 | 90 | 0.29 | 80 | — | — | — | — | — | Sulfuric acid |
| EX 29 | Sulfuric acid | $H_2SO_4$/Al | 170/5 | 55 | 90 | 0.29 | 80 | — | — | — | — | — | Sulfuric acid |
| EX 30 | Sulfuric acid | $H_2SO_4$/Al | 170/5 | 55 | 90 | 0.29 | 80 | — | — | — | — | — | Sulfuric acid |

TABLE 1-continued

| | Second anodizing treatment | | | | | | Third anodizing treatment | | | | | | |
|---|---|---|---|---|---|---|---|---|---|---|---|---|---|
| | Liquid ingre-dient | Ingre-dient Conc. (g/l) | Temp. (° C.) | Cur-rent density (A/dm$^{2)}$ | Time (s) | thick-ness (nm) | Liquid type | Liquid ingre-dient | Ingre-dient Conc. (g/l) | Temp. (° C.) | Cur-rent density (A/dm$^2$) | Time (s) | Film thick-ness (nm) |
| EX 1 | $H_2SO_4$/Al | 170/5 | 54 | 15 | 14 | 1000 | — | — | — | — | — | — | — |
| EX 2 | $H_2SO_4$/Al | 170/5 | 54 | 15 | 14 | 1000 | — | — | — | — | — | — | — |
| EX 3 | $H_2SO_4$/Al | 170/5 | 54 | 15 | 14 | 1000 | — | — | — | — | — | — | — |
| EX 4 | $H_2SO_4$/Al | 170/5 | 54 | 15 | 14 | 1000 | — | — | — | — | — | — | — |
| EX 5 | $H_2SO_4$/Al | 170/5 | 54 | 15 | 14 | 1000 | — | — | — | — | — | — | — |
| EX 6 | $H_2SO_4$/Al | 170/5 | 54 | 15 | 14 | 1000 | — | — | — | — | — | — | — |
| EX 7 | $H_2SO_4$/Al | 170/5 | 54 | 15 | 14 | 1000 | — | — | — | — | — | — | — |
| EX 8 | $H_2SO_4$/Al | 170/5 | 54 | 15 | 14 | 1000 | — | — | — | — | — | — | — |
| EX 9 | $H_2SO_4$/Al | 170/5 | 54 | 15 | 14 | 1000 | — | — | — | — | — | — | — |
| EX 10 | $H_2SO_4$/Al | 170/5 | 54 | 15 | 14 | 1000 | — | — | — | — | — | — | — |
| EX 11 | $H_2SO_4$/Al | 170/5 | 54 | 15 | 14 | 1000 | — | — | — | — | — | — | — |
| EX 12 | $H_2SO_4$/Al | 170/5 | 54 | 15 | 14 | 1000 | — | — | — | — | — | — | — |
| EX 13 | $H_2SO_4$/Al | 170/5 | 54 | 15 | 13 | 900 | Sulfuric acid | $H_2SO_4$/Al | 170/5 | 54 | 30 | 0.7 | 100 |
| EX 14 | $H_2SO_4$/Al | 170/5 | 54 | 15 | 13 | 900 | Sulfuric acid | $H_2SO_4$/Al | 170/5 | 54 | 40 | 0.5 | 100 |
| EX 15 | $H_2SO_4$/Al | 170/5 | 54 | 15 | 13 | 900 | Sulfuric acid | $H_2SO_4$/Al | 170/5 | 54 | 50 | 0.4 | 100 |
| EX 16 | $H_2SO_4$/Al | 170/5 | 54 | 12 | 18 | 1000 | — | — | — | — | — | — | — |
| EX 17 | $H_2SO_4$/Al | 170/5 | 54 | 9 | 23 | 1000 | — | — | — | — | — | — | — |
| EX 18 | $H_2SO_4$/Al | 170/5 | 54 | 15 | 20 | 1420 | — | — | — | — | — | — | — |
| EX 19 | $H_2SO_4$/Al | 170/5 | 54 | 15 | 27 | 1920 | — | — | — | — | — | — | — |
| EX 20 | $H_2SO_4$/Al | 170/5 | 54 | 15 | 14 | 1000 | — | — | — | — | — | — | — |
| EX 21 | $H_2SO_4$/Al | 170/5 | 54 | 15 | 14 | 1000 | — | — | — | — | — | — | — |
| EX 22 | $H_2SO_4$/Al | 170/5 | 54 | 15 | 14 | 1000 | — | — | — | — | — | — | — |
| EX 23 | $H_2SO_4$/Al | 170/5 | 54 | 15 | 14 | 1000 | — | — | — | — | — | — | — |
| EX 24 | $H_2SO_4$/Al | 170/5 | 54 | 20 | 11 | 1000 | — | — | — | — | — | — | — |
| EX 25 | $H_2SO_4$/Al | 170/5 | 54 | 11 | 19 | 1000 | — | — | — | — | — | — | — |
| EX 26 | $H_2SO_4$/Al | 170/5 | 54 | 15 | 13 | 900 | Sulfuric acid | $H_2SO_4$/Al | 170/5 | 54 | 13 | 1.6 | 100 |
| EX 27 | $H_2SO_4$/Al | 170/5 | 54 | 15 | 13 | 900 | Sulfuric | $H_2SO_4$/Al | 170/5 | 54 | 30 | 1.6 | 125 |
| EX 28 | $H_2SO_4$/Al | 170/5 | 54 | 15 | 13 | 900 | Sulfuric acid | $H_2SO_4$/Al | 170/5 | 54 | 30 | 1.6 | 150 |
| EX 29 | $H_2SO_4$/Al | 170/5 | 54 | 15 | 13 | 900 | Sulfuric acid | $H_2SO_4$/Al | 170/5 | 54 | 30 | 1.6 | 175 |
| EX 30 | $H_2SO_4$/Al | 170/5 | 54 | 15 | 13 | 900 | Sulfuric acid | $H_2SO_4$/Al | 170/5 | 54 | 30 | 1.6 | 200 |

| | First anodizing treatment | | | | | | | Pore-widening treatment | | | | | Second anodizing treatment |
|---|---|---|---|---|---|---|---|---|---|---|---|---|---|
| | Liquid type | Liquid ingre-dient | Ingre-dient Conc. (g/l) | Temp. (° C.) | Cur-rent density (A/dm$^2$) | Time (s) | Film thick-ness (nm) | Liquid type | Solu-tion | Conc. (wt %) | Temp. (° C.) | Time (s) | Liquid type |
| CE 1 | Sulfuric acid | $H_2SO_4$/Al | 170/5 | 55 | 90 | 0.21 | 58 | — | — | — | — | — | Sulfuric acid |

TABLE 1-continued

| | | | | | | | | | | | | | |
|---|---|---|---|---|---|---|---|---|---|---|---|---|---|
| CE 2 | Sulfuric acid | $H_2SO_4$/Al | 170/5 | 55 | 90 | 0.43 | 118 | — | — | — | — | — | Sulfuric acid |
| CE 3 | Sulfuric acid | $H_2SO_4$/Al | 170/5 | 55 | 90 | 1.01 | 278 | — | — | — | — | — | Sulfuric acid |
| CE 4 | Sulfuric acid | $H_2SO_4$/Al | 170/5 | 55 | 90 | 0.21 | 58 | Sodium hydroxide | NaOH/Al | 5/0.5 | 35 | 6 | Sulfuric acid |
| CE 5 | Sulfuric acid | $H_2SO_4$/Al | 170/5 | 55 | 90 | 0.21 | 58 | — | — | — | — | — | Sulfuric acid |
| CE 6 | Sulfuric acid | $H_2SO_4$/Al | 170/5 | 55 | 90 | 0.43 | 118 | — | — | — | — | — | Sulfuric acid |
| CE 7 | Sulfuric acid | $H_2SO_4$/Al | 80/5 | 55 | 90 | 0.21 | 58 | Sodium hydroxide | NaOH/Al | 5/0.5 | 35 | 6 | Sulfuric acid |
| CE 8 | Sulfuric acid | $H_2SO_4$/Al | 170/5 | 55 | 90 | 0.21 | 58 | — | — | — | — | — | Sulfuric acid |
| CE 9 | Sulfuric acid | $H_2SO_4$/Al | 170/5 | 43 | 30 | 0.67 | 61 | Sodium hydroxide | NaOH/Al | 5/0.5 | 35 | 6 | Sulfuric acid |
| CE 10 | Sulfuric acid | $H_2SO_4$/Al | 170/5 | 43 | 30 | 0.57 | 52 | Sodium hydroxide | NaOH/Al | 5/0.5 | 35 | 1 | Sulfuric acid |
| CE 11 | Sulfuric acid | $H_2SO_4$/Al | 170/5 | 43 | 30 | 0.62 | 57 | Sodium hydroxide | NaOH/Al | 5/0.5 | 35 | 4 | Sulfuric acid |
| CE 12 | Sulfuric acid | $H_2SO_4$/Al | 170/5 | 43 | 10 | 1.67 | 51 | Sodium hydroxide | NaOH/Al | 5/0.5 | 35 | 6 | Sulfuric acid |
| CE 13 | Sulfuric acid | $H_2SO_4$/Al | 170/5 | 55 | 17 | 2.12 | 110 | — | — | — | — | — | Sulfuric acid |
| CE 14 | Sulfuric acid | $H_2SO_4$/Al | 5/5 | 55 | 120 | 0.30 | 75 | — | — | — | — | — | Sulfuric acid |
| CE 15 | Sulfuric acid | $H_2SO_4$/Al | 220/5 | 55 | 17 | 2.12 | 110 | — | — | — | — | — | Sulfuric acid |
| CE 16 | Sulfuric acid | $H_2SO_4$/Al | 5/5 | 60 | 120 | 0.30 | 110 | — | — | — | — | — | Sulfuric acid |
| CE 17 | Sulfuric acid | $H_2SO_4$/Al | 80/5 | 60 | 17 | 2.12 | 110 | — | — | — | — | — | Sulfuric acid |
| CE 18 | Sulfuric acid | $H_2SO_4$/Al | 340/5 | 55 | 17 | 2.12 | 110 | — | — | — | — | — | Sulfuric acid |
| CE 19 | Phosphoric acid | $H_2SO_4$/Al | 10/5 | 55 | 17 | 2.12 | 110 | — | — | — | — | — | Sulfuric acid |
| CE 20 | Sulfuric acid | $H_2SO_4$/Al | 170/5 | 55 | 90 | 0.40 | 110 | — | — | — | — | — | Sulfuric acid |
| CE 21 | Sulfuric acid | $H_2SO_4$/Al | 170/5 | 55 | 90 | 0.40 | 110 | — | — | — | — | — | Sulfuric acid |
| CE 22 | Sulfuric acid | $H_2SO_4$/Al | 170/5 | 55 | 2 | 18.00 | 110 | — | — | — | — | — | Sulfuric acid |

| | Second anodizing treatment | | | | | | Third anodizing treatment | | | | | | |
|---|---|---|---|---|---|---|---|---|---|---|---|---|---|
| | Liquid ingredient | Ingredient Conc. (g/l) | Temp. (° C.) | Current density (A/dm$^2$) | Time (s) | Film thickness (nm) | Liquid type | Liquid ingredient | Ingredient Conc. (g/l) | Temp. (° C.) | Current density (A/dm$^2$) | Time (s) | Film thickness (nm) |
| CE 1 | $H_2SO_4$/Al | 170/5 | 60 | 15 | 14 | 1000 | — | — | — | — | — | — | — |
| CE 2 | $H_2SO_4$/Al | 170/5 | 60 | 15 | 14 | 1000 | — | — | — | — | — | — | — |
| CE 3 | $H_2SO_4$/Al | 170/5 | 60 | 15 | 14 | 1000 | — | — | — | — | — | — | — |
| CE 4 | $H_2SO_4$/Al | 170/5 | 60 | 15 | 14 | 1000 | — | — | — | — | — | — | — |
| CE 5 | $H_2SO_4$/Al | 170/5 | 53 | 15 | 14 | 1000 | — | — | — | — | — | — | — |
| CE 6 | $H_2SO_4$/Al | 170/5 | 53 | 15 | 14 | 1000 | — | — | — | — | — | — | — |
| CE 7 | $H_2SO_4$/Al | 170/5 | 53 | 15 | 14 | 1000 | — | — | — | — | — | — | — |
| CE 8 | $H_2SO_4$/Al | 170/5 | 53 | 15 | 14 | 1000 | — | — | — | — | — | — | — |
| CE 9 | $H_2SO_4$/Al | 170/5 | 40 | 20 | 11 | 1000 | — | — | — | — | — | — | — |
| CE 10 | $H_2SO_4$/Al | 170/5 | 40 | 20 | 11 | 1000 | — | — | — | — | — | — | — |
| CE 11 | $H_2SO_4$/Al | 170/5 | 40 | 20 | 11 | 1000 | — | — | — | — | — | — | — |
| CE 12 | $H_2SO_4$/Al | 170/5 | 40 | 20 | 11 | 1000 | — | — | — | — | — | — | — |
| CE 13 | $H_2SO_4$/Al | 170/5 | 53 | 15 | 14 | 1000 | — | — | — | — | — | — | — |
| CE 14 | $H_2SO_4$/Al | 170/5 | 53 | 15 | 14 | 1000 | — | — | — | — | — | — | — |

TABLE 1-continued

| | | | | | | | | | | | | | |
|---|---|---|---|---|---|---|---|---|---|---|---|---|---|
| CE 15 | $H_2SO_4$/Al | 170/5 | 53 | 15 | 14 | 1000 | — | — | — | — | — | — | — |
| CE 16 | $H_2SO_4$/Al | 170/5 | 53 | 15 | 14 | 1000 | — | — | — | — | — | — | — |
| CE 17 | $H_2SO_4$/Al | 170/5 | 53 | 15 | 14 | 1000 | — | — | — | — | — | — | — |
| CE 18 | $H_2SO_4$/Al | 170/5 | 53 | 15 | 14 | 1000 | — | — | — | — | — | — | — |
| CE 19 | $H_2SO_4$/Al | 170/5 | 53 | 15 | 14 | 1000 | — | — | — | — | — | — | — |
| CE 20 | $H_2SO_4$/Al | 170/5 | 60 | 20 | 14 | 1000 | — | — | — | — | — | — | — |
| CE 21 | $H_2SO_4$/Al | 170/5 | 53 | 15 | 7.3 | 520 | — | — | — | — | — | — | — |
| CE 22 | $H_2SO_4$/Al | 170/5 | 53 | 15 | 14 | 1000 | — | — | — | — | — | — | — |

TABLE 2

| | Micropore | | | | | | |
|---|---|---|---|---|---|---|---|
| | Large-diameter portion | | | | | | Small-diameter portion Average diameter (nm) |
| | Surface layer average diameter (nm) | Bottom average diameter (nm) | Average depth (nm) | Average depth/Surface layer average diameter | Average depth/Bottom average diameter | Shape | |
| EX 1 | 12 | 25 | 98 | 8.2 | 3.9 | Inversely tapered shape | 9.8 |
| EX 2 | 12 | 25 | 76 | 6.3 | 3.0 | Inversely tapered shape | 9.8 |
| EX 3 | 12 | 25 | 118 | 9.8 | 4.7 | Inversely tapered shape | 9.8 |
| EX 4 | 15 | 25 | 98 | 6.5 | 3.9 | Inversely tapered shape | 9.8 |
| EX 5 | 15 | 25 | 76 | 5.1 | 3.0 | Inversely tapered shape | 9.8 |
| EX 6 | 15 | 25 | 118 | 7.9 | 4.7 | Inversely tapered shape | 9.8 |
| EX 7 | 12 | 12 | 87 | 7.3 | 7.3 | Straight tubular shape | 9.8 |
| EX 8 | 28 | 55 | 118 | 4.2 | 2.1 | Inversely tapered shape | 9.8 |
| EX 9 | 21 | 35 | 116 | 5.5 | 3.3 | Inversely tapered shape | 9.8 |
| EX 10 | 11 | 23 | 87 | 7.9 | 3.8 | Inversely tapered shape | 9.8 |
| EX 11 | 12 | 25 | 103 | 8.6 | 4.1 | Inversely tapered shape | 9.8 |
| EX 12 | 13 | 26 | 108 | 8.3 | 4.2 | Inversely tapered shape | 9.8 |
| EX 13 | 12 | 25 | 98 | 8.2 | 3.9 | Inversely tapered shape | 9.8 |
| EX 14 | 12 | 25 | 98 | 8.2 | 3.9 | Inversely tapered shape | 9.8 |
| EX 15 | 12 | 25 | 98 | 8.2 | 3.9 | Inversely tapered shape | 9.8 |
| EX 16 | 12 | 25 | 98 | 8.2 | 3.9 | Inversely tapered shape | 9.4 |
| EX 17 | 12 | 25 | 98 | 8.2 | 3.9 | Inversely tapered shape | 8.8 |
| EX 18 | 12 | 25 | 98 | 8.2 | 3.9 | Inversely tapered shape | 9.8 |
| EX 19 | 12 | 25 | 98 | 8.2 | 3.9 | Inversely tapered shape | 9.8 |
| EX 20 | 24 | 36 | 98 | 4.1 | 2.7 | Inversely tapered shape | 9.8 |
| EX 21 | 17 | 25 | 98 | 5.8 | 3.9 | Inversely tapered shape | 9.8 |
| EX 22 | 11 | 17 | 98 | 8.9 | 5.8 | Inversely tapered shape | 9.8 |
| EX 23 | 11 | 11 | 98 | 8.9 | 8.9 | Straight tubular shape | 9.8 |
| EX 24 | 12 | 25 | 98 | 8.2 | 3.9 | Inversely tapered shape | 9.8 |
| EX 25 | 12 | 25 | 98 | 8.2 | 3.9 | Inversely tapered shape | 9.8 |
| EX 26 | 12 | 25 | 98 | 8.2 | 3.9 | Inversely tapered shape | 9.8 |
| EX 27 | 12 | 25 | 98 | 8.2 | 3.9 | Inversely tapered shape | 9.8 |
| EX 28 | 12 | 25 | 98 | 8.2 | 3.9 | Inversely tapered shape | 9.8 |
| EX 29 | 12 | 25 | 98 | 8.2 | 3.9 | Inversely tapered shape | 9.8 |
| EX 30 | 12 | 25 | 98 | 8.2 | 3.9 | Inversely tapered shape | 9.8 |

| | Micropore | | | | | | |
|---|---|---|---|---|---|---|---|
| | Small-diameter portion | | | | | | Ratio (Surface |
| | Average depth (nm) | Communicating portion density (pcs/μm$^2$) | Barrier layer average thickness (nm) | Barrier layer minimum thickness (nm) | Micropore density (pcs/μm$^2$) | Surface area increase rate | layer average diameter/Small-diameter portion diameter) |
| EX 1 | 983 | 800 | 17 | — | 500 | 4.0 | 1.22 |
| EX 2 | 983 | 800 | 17 | — | 500 | 3.4 | 1.22 |
| EX 3 | 983 | 800 | 17 | — | 500 | 4.6 | 1.22 |
| EX 4 | 983 | 800 | 17 | — | 450 | 3.9 | 1.53 |
| EX 5 | 983 | 800 | 17 | — | 450 | 3.3 | 1.53 |
| EX 6 | 983 | 800 | 17 | — | 450 | 4.5 | 1.53 |
| EX 7 | 983 | 800 | 17 | — | 500 | 2.6 | 1.22 |

TABLE 2-continued

| | | | | | | | |
|---|---|---|---|---|---|---|---|
| EX 8 | 983 | 800 | 17 | — | 300 | 6.2 | 2.86 |
| EX 9 | 983 | 800 | 17 | — | 400 | 5.3 | 2.14 |
| EX 10 | 983 | 800 | 17 | — | 650 | 4.2 | 1.12 |
| EX 11 | 983 | 800 | 17 | — | 500 | 4.2 | 1.22 |
| EX 12 | 983 | 800 | 17 | — | 500 | 4.5 | 1.33 |
| EX 13 | 898, 978 | 800(700) | 17 | 15 | 500 | 4.0 | 1.22 |
| EX 14 | 892, 972 | 800(675) | 17 | 16 | 500 | 4.0 | 1.22 |
| EX 15 | 888, 968 | 800(650) | 17 | 16 | 500 | 4.0 | 1.22 |
| EX 16 | 983 | 800 | 17 | — | 500 | 4.0 | 1.28 |
| EX 17 | 983 | 800 | 17 | — | 500 | 4.0 | 1.36 |
| EX 18 | 1403 | 800 | 17 | — | 500 | 4.0 | 1.22 |
| EX 19 | 1903 | 800 | 17 | — | 500 | 4.0 | 1.22 |
| EX 20 | 983 | 800 | 17 | — | 400 | 4.9 | 2.45 |
| EX 21 | 983 | 800 | 17 | — | 500 | 4.4 | 1.73 |
| EX 22 | 983 | 800 | 17 | — | 650 | 3.9 | 1.12 |
| EX 23 | 983 | 800 | 17 | — | 650 | 3.2 | 1.12 |
| EX 24 | 983 | 600 | 17 | — | 500 | 4.0 | 1.22 |
| EX 25 | 983 | 1100 | 17 | — | 500 | 4.0 | 1.22 |
| EX 26 | 905, 985 | 800(700) | 17 | 15 | 500 | 4.0 | 1.22 |
| EX 27 | 873, 978 | 800(600) | 19 | 16 | 500 | 4.0 | 1.22 |
| EX 28 | 848, 978 | 800(600) | 20 | 17 | 500 | 4.0 | 1.22 |
| EX 29 | 823, 978 | 800(600) | 21 | 18 | 500 | 4.0 | 1.22 |
| EX 30 | 798, 978 | 800(600) | 22 | 18 | 500 | 4.0 | 1.22 |

| | Micropore | | | | | | |
|---|---|---|---|---|---|---|---|
| | Large-diameter portion | | | | | | |
| | Surface layer average diameter (nm) | Bottom average diameter (nm) | Average depth (nm) | Average depth/ Surface layer average diameter | Average depth/ Bottom average diameter | Shape | Small-diameter portion Average diameter (nm) |
| CE 1 | 12 | 25 | 70 | 5.8 | 2.8 | Inversely tapered shape | 14 |
| CE 2 | 13 | 25 | 130 | 10.0 | 5.2 | Inversely tapered shape | 14 |
| CE 3 | 14 | 25 | 290 | 20.7 | 11.6 | Inversely tapered shape | 14 |
| CE 4 | 25 | 25 | 70 | 2.8 | 2.8 | Straight tubular shape | 14 |
| CE 5 | 12 | 25 | 70 | 5.8 | 2.8 | Inversely tapered shape | 9.8 |
| CE 6 | 13 | 25 | 130 | 10.0 | 5.2 | Inversely tapered shape | 9.8 |
| CE 7 | 25 | 25 | 70 | 2.8 | 2.8 | Inversely tapered shape | 9.8 |
| CE 8 | 12 | 25 | 70 | 5.8 | 2.8 | Inversely tapered shape | 9.8 |
| CE 9 | 25 | 25 | 25 | 1.0 | 1.0 | Straight tubular shape | 8.0 |
| CE 10 | 12 | 12 | 25 | 2.1 | 2.1 | Straight tubular shape | 8.0 |
| CE 11 | 20 | 20 | 25 | 1.3 | 1.3 | Straight tubular shape | 8.0 |
| CE 12 | 25 | 25 | 25 | 1.0 | 1.0 | Straight tubular shape | 8.0 |
| CE 13 | 9 | 15 | 98 | 10.9 | 6.5 | Inversely tapered shape | 9.8 |
| CE 14 | 52 | 65 | 98 | 1.9 | 1.5 | Inversely tapered shape | 9.8 |
| CE 15 | 9 | 9 | 98 | 10.9 | 10.9 | Straight tubular shape | 9.8 |
| CE 16 | 44 | 65 | 98 | 2.2 | 1.5 | Inversely tapered shape | 9.8 |
| CE 17 | 28 | 43 | 98 | 3.5 | 2.3 | Inversely tapered shape | 9.8 |
| CE 18 | 8 | 8 | 98 | 12.3 | 12.3 | Straight tubular shape | 9.8 |
| CE 19 | 88 | 105 | 98 | 1.1 | 0.9 | Inversely tapered shape | 9.8 |
| CE 20 | 12 | 25 | 98 | 8.2 | 3.9 | Inversely tapered shape | 11 |
| CE 21 | 12 | 25 | 98 | 8.2 | 3.9 | Inversely tapered shape | 9.8 |
| CE 22 | 9 | 9 | 98 | 10.9 | 10.9 | Straight tubular shape | 9.8 |

| | Micropore | | | | | |
|---|---|---|---|---|---|---|
| | Small-diameter portion | | | | | Ratio (Surface |
| | Average depth (nm) | Communicating portion density (pcs/μm$^2$) | Barrier layer average thickness (nm) | Micropore density (pcs/μm$^2$) | Surface area increase rate | layer average diameter/Small-diameter portion diameter) |
| CE 1 | 983 | 500 | 17 | 500 | 3.2 | 0.86 |
| CE 2 | 983 | 500 | 17 | 500 | 5.1 | 0.93 |
| CE 3 | 983 | 500 | 17 | 500 | 10.1 | 1.00 |
| CE 4 | 983 | 500 | 17 | 500 | 3.7 | 1.79 |
| CE 5 | 983 | 500 | 17 | 500 | 3.2 | 1.22 |
| CE 6 | 983 | 500 | 17 | 500 | 5.1 | 1.33 |
| CE 7 | 983 | 500 | 17 | 500 | 3.7 | 2.55 |
| CE 8 | 983 | 500 | 17 | 500 | 3.2 | 1.22 |
| CE 9 | 980 | 500 | 17 | 500 | 2.0 | 3.13 |
| CE 10 | 980 | 500 | 17 | 500 | 1.5 | 1.50 |
| CE 11 | 980 | 500 | 17 | 500 | 1.8 | 2.50 |
| CE 12 | 980 | 2800 | 17 | 2800 | 6.5 | 3.13 |
| CE 13 | 983 | 500 | 17 | 650 | 3.5 | 0.92 |

TABLE 2-continued

| | | | | | | |
|---|---|---|---|---|---|---|
| CE 14 | 983 | 500 | 17 | 300 | 6.8 | 5.31 |
| CE 15 | 983 | 500 | 17 | 700 | 2.9 | 0.92 |
| CE 16 | 983 | 500 | 17 | 250 | 5.7 | 4.49 |
| CE 17 | 983 | 500 | 17 | 350 | 5.1 | 2.86 |
| CE 18 | 983 | 500 | 17 | 700 | 2.7 | 0.82 |
| CE 19 | 983 | 500 | 17 | 200 | 7.5 | 8.98 |
| CE 20 | 983 | 500 | 17 | 500 | 4.0 | 1.09 |
| CE 21 | 503 | 500 | 17 | 500 | 4.0 | 1.22 |
| CE 22 | 983 | 500 | 17 | 2800 | 8.8 | 0.92 |

In Examples 1 to 30, micropores having specified average diameter and average depth were formed in the anodized aluminum film.

Manufacture of Lithographic Printing Plate Precursor (Part 1)

An undercoating solution of the composition indicated below was applied onto each lithographic printing plate support manufactured as described above to a coating weight after drying of 28 mg/m$^2$ to thereby form an undercoat layer.

<Undercoat Layer-Forming Coating Liquid>

Undercoat layer compound (1) of the structure shown below 0.18 g

Hydroxyethyl iminodiacetic acid 0.10 g

Methanol 55.24 g

Water 6.15 g

[Chemical Formula 2]

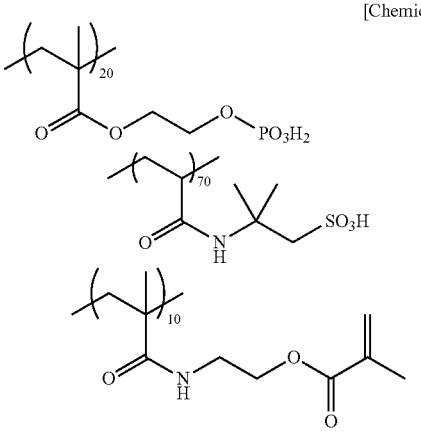

Then, an image recording layer-forming coating liquid was applied onto the thus formed undercoat layer by bar coating and dried in an oven at 100° C. for 60 seconds to form an image recording layer having a coating weight after drying of 1.3 g/m$^2$.

The image recording layer-forming coating liquid was obtained by mixing with stirring the photosensitive solution and the microgel solution just before use in application.

<Photosensitive Solution>

Binder polymer (1) [of the structure below] 0.24 g

Infrared absorber (1) [of the structure below] 0.030 g

Radical polymerization initiator (1) [of the structure below] 0.162 g

Polymerizable compound, tris(acryloyloxyethyl)isocyanurate (NK Ester A-9300 available from Shin-Nakamura Chemical Corporation) 0.192 g Low-molecular-weight hydrophilic compound, tris(2-hydroxyethyl)isocyanurate 0.062 g Low-molecular-weight hydrophilic compound (1) [of the structure below] 0.052 g Ink receptivity enhancer Phosphonium compound (1) [of the structure below] 0.055 g Ink receptivity enhancer Benzyl-dimethyl-octyl ammonium.$PF_6$ salt 0.018 g Betaine derivative (C-1) 0.010 g Fluorosurfactant (1) (weight-average molecular weight, 10,000) [of the structure below] 0.008 g Methyl ethyl ketone 1.091 g 1-Methoxy-2-propanol 8.609 g <Microgel Solution>

Microgel (1) 2.640 g

Distilled water 2.425 g

The binder polymer (1), the infrared absorber (1), the radical polymerization initiator (1), the phosphonium compound (1), the low-molecular-weight hydrophilic compound (1) and the fluorosurfactant (1) have the structures represented by the following formulas:

[Chemical Formula 4]

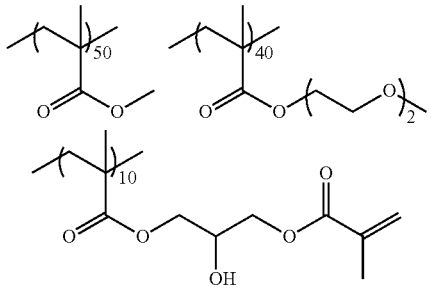

Binder polymer (1)
(Mw 70,000)

[Chemical Formula 4]

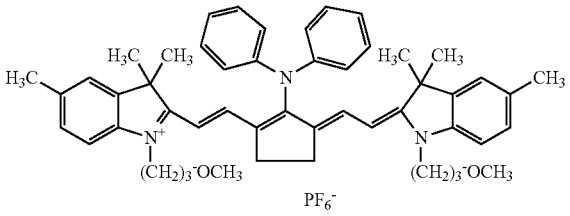

Infrared absorber (1)

-continued

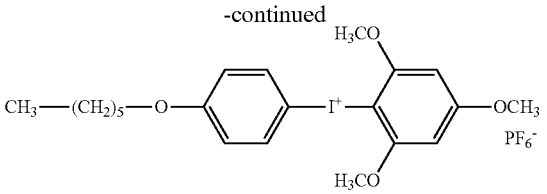

Polymerization initiator (1)

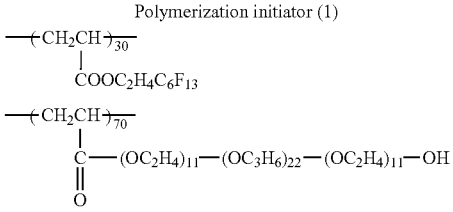

Fluorosurfactant (1)

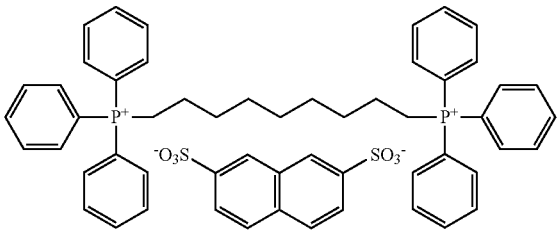

Phosphonium compound (1)

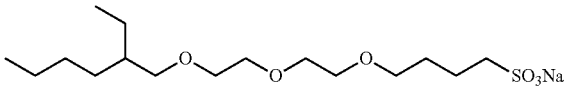

Low-molecular-weight hydrophilic compound (1)

(C-1)

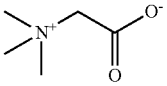

The microgel (1) was synthesized as follows.

<Synthesis of Microgel (1)>

For the oil phase component, 10 g of an adduct of trimethylolpropane with xylene diisocyanate (Takenate D-110N available from Mitsui Takeda Chemicals, Inc.), 3.15 g of pentaerythritol triacrylate (SR444 available from Nippon Kayaku Co., Ltd.) and 0.1 g of Pionin A-41C (available from Takemoto Oil & Fat Co., Ltd.) were dissolved in 17 g of ethyl acetate. For the aqueous phase component, 40 g of a 4 wt % aqueous solution of PVA-205 was prepared. The oil phase component and the aqueous phase component were mixed and emulsified in a homogenizer at 12,000 rpm for 10 minutes. The resulting emulsion was added to 25 g of distilled water and the mixture was stirred at room temperature for 30 minutes, then at 50° C. for 3 hours. The thus obtained microgel solution was diluted with distilled water so as to have a solids concentration of 15 wt % and used as the microgel (1). The average particle size of the microgel as measured by a light scattering method was 0.2 μm.

Then, a protective layer-forming coating liquid of the composition indicated below was applied onto the thus formed image recording layer by bar coating and dried in an oven at 120° C. for 60 seconds to form a protective layer having a coating weight after drying of 0.15 g/m$^2$, thereby obtaining a lithographic printing plate precursor.

<Protective Layer-Forming Coating Liquid>

Dispersion of an inorganic layered compound (1) 1.5 g 6 wt % Aqueous solution of polyvinyl alcohol (CKS50; modified with sulfonic acid; degree of saponification, at least 99 mol %; degree of polymerization, 300; available from The Nippon Synthetic Chemical Industry Co., Ltd.) 0.55 g 6 wt % Aqueous solution of polyvinyl alcohol (PVA-405; degree of saponification, 81.5 mol %; degree of polymerization, 500; available from Kuraray Co., Ltd.) 0.03 g 1 wt % Aqueous solution of surfactant (EMALEX 710 available from Nihon Emulsion Co., Ltd.) 8.60 g Ion exchanged water 6.0 g The dispersion of an inorganic layered compound (1) was prepared as follows.

(Preparation of Dispersion of Inorganic Layered Compound (1))

Synthetic mica Somasif ME-100 (available from Co-Op Chemical Co., Ltd.) in an amount of 6.4 g was added to 193.6 g of ion-exchanged water and dispersed in the water with a homogenizer to an average particle size (as measured by a laser scattering method) of 3 μm. The resulting dispersed particles had an aspect ratio of at least 100.

<Evaluation of Lithographic Printing Plate Precursor>

(On-Press Developability)

The resulting lithographic printing plate precursor was exposed by Luxel PLATESETTER T-6000III from FUJIFILM Corporation equipped with an infrared semiconductor laser at an external drum rotational speed of 1,000 rpm, a laser power of 70% and a resolution of 2,400 dpi. The exposed image was set to contain a solid image and a 50% halftone chart of a 20 μm-dot FM screen.

The resulting lithographic printing plate precursor after exposure was mounted without development process on the plate cylinder of a Lithrone 26 printing press available from Komori Corporation. A fountain solution of Ecolity-2 (FUJIFILM Corporation)/tap water at (a volume ratio of) 2/98 and Values-G (N) black ink (Dainippon Ink & Chemicals, Inc.) were used. The fountain solution and the ink were supplied by the standard automatic printing start-up procedure on the Lithrone 26 to perform on-press development, and printing was performed with 100 sheets of Tokubishi art paper (76.5 kg) at a printing rate of 10,000 sheets per hour.

The on-press developability was evaluated as the number of sheets of printing paper required to reach the state in which no ink is transferred to halftone non-image areas after the completion of the on-press development of the unexposed areas of the 50% halftone chart on the printing press. The on-press developability was rated, in the order from the excellent one, "A" (when the number of wasted sheets was up to 15), "B" (when the number of wasted sheets was from 16 to 19), "C" (when the number of wasted sheets was from 20 to 30) and "D" (when the number of wasted sheets was 31 or more). The results are shown in Table 3.

(Deinking Ability after Suspended Printing)

Once good impressions were obtained after the end of the on-press development, printing was suspended and the printing plate was left to stand on the printing press for 1 hour in a room at a temperature of 25° C. and a humidity of 50%. Then, printing was resumed and the deinking ability after suspended printing was evaluated as the number of wasted sheets of printing paper required to obtain a good unstained impression. The deinking ability after suspended printing was rated, in the order from the excellent one, "A" (when the number of wasted sheets was up to 75), "B" (when the number of wasted sheets was 76 to 300) and "C" (when the number of wasted sheets was 301 or more). The results are shown in Table 3.

(Press Life)

On-press development was performed on the same type of printing press by the same procedure as above and printing was further continued. The press life was evaluated by the number of impressions at the time when the decrease in density of a solid image became visually recognizable. The press life was rated "D" when the number of impressions was less than 30,000, "C" when the number of impressions was at least 30,000 but less than 35,000, "B" when the number of impressions was at least 35,000 but less than 37,500, and "A" when the number of impressions was 37,500 or more. The results are shown in Table 3. It is necessary for the evaluation results in Table 3 not to include "D" or "C."

(Deinking Ability in Continued Printing)

Once good impressions were obtained after the end of the on-press development, Fusion-EZ(S) ink (Dainippon Ink & Chemicals, Inc.) to which varnish was added was applied to non-image areas of the lithographic printing plate. Then, printing was resumed and the deinking ability in continued printing was evaluated as the number of sheets of printing paper required to obtain a good unstained impression. The deinking ability in continued printing was rated, in the order from the excellent one, "A" (when the number of wasted sheets was up to 10), "B" (when the number of wasted sheets was more than 10 but up to 20), "C" (when the number of wasted sheets was more than 20 but up to 30) and "D" (when the number of wasted sheets was more than 30). The results are shown in Table 3.

(Scratch Resistance)

The surface of the resulting lithographic printing plate support was subjected to a scratch test to evaluate the scratch resistance of the lithographic printing plate support.

The scratch test was performed using a continuous loading-type scratch strength tester (SB-53 manufactured by Shinto Scientific Co., Ltd.) by moving a sapphire needle with a diameter of 0.4 mm at a moving velocity of 10 cm/s and at a load of 100 g.

As a result, the support in which scratches due to the needle did not reach the surface of the aluminum alloy plate (base) was rated "A" as having excellent scratch resistance and the support in which scratches reached the plate surface was rated "B." The lithographic printing plate support exhibiting excellent scratch resistance at a load of 100 g can suppress the transfer of scratches to the image recording layer when the lithographic printing plate precursor prepared therefrom is mounted on the plate cylinder or superposed on another, thus reducing scumming in non-image areas. It is necessary for the scratch resistance to be rated "A" for practical use.

(Microdots (Dotted Scumming))

The resulting lithographic printing plate precursor was conditioned in humidity along with an interleaving sheet at 25° C. and 70% RH for 1 hour, wrapped with aluminum kraft paper and heated in an oven set at 60° C. for 10 days.

Then, the temperature was decreased to room temperature. On-press development was performed on the same type of printing press by the same procedure as above and 500 impressions were made. The 500th impression was visually checked and the number per 80 $cm^2$ of print stains (dotted scumming) with a size of at least 20 μm was counted.

The dotted scumming was rated "E" when the number of stains was at least 200, "D" when the number of stains was at least 150 but less than 200, "C" when the number of stains was at least 100 but less than 150, "B" when the number of stains was at least 50 but less than 100, "A" when the number of stains was at least 30 but less than 50, and "AA" when the number of stains was less than 30.

The resistance to dotted scumming is preferably not rated "E" for practical use.

TABLE 3

| | Press life | Deinking ability after suspended printing | deinking ability in continued printing | On-press develop-ability | Scratch resis-tance | Micro-dot |
|---|---|---|---|---|---|---|
| EX 1 | A | A | A | A | A | B |
| EX 2 | B | A | A | A | A | B |
| EX 3 | A | A | A | B | A | B |
| EX 4 | A | B | B | A | A | B |
| EX 5 | A | B | B | A | A | B |
| EX 6 | A | B | B | B | A | B |
| EX 7 | A | B | B | B | A | B |
| EX 8 | B | B | B | B | A | B |
| EX 9 | A | B | B | B | A | B |
| EX 10 | A | A | A | A | A | B |
| EX 11 | A | A | A | A | A | B |
| EX 12 | A | A | A | B | A | B |
| EX 13 | A | A | A | A | A | A |
| EX 14 | A | A | A | A | A | A |
| EX 15 | A | A | A | A | A | A |
| EX 16 | A | A | A | A | A | B |
| EX 17 | A | A | A | A | A | B |
| EX 18 | A | A | A | A | A | B |
| EX 19 | A | B | B | B | A | B |
| EX 20 | A | B | B | B | A | B |
| EX 21 | A | A | A | A | A | B |
| EX 22 | B | A | A | A | A | B |
| EX 23 | A | A | A | A | A | B |
| EX 24 | A | A | A | A | A | B |
| EX 25 | A | A | A | A | A | B |
| EX 26 | A | A | A | A | A | AA |
| EX 27 | A | A | A | A | A | AA |
| EX 28 | A | A | A | A | A | AA |
| EX 29 | A | A | A | A | A | AA |
| EX 30 | A | A | A | A | A | AA |

| | Press life | Deinking ability after suspended printing | deinking ability in continued printing | On-press develop-ability | Scratch resis-tance | Micro-dot |
|---|---|---|---|---|---|---|
| CE 1 | C | A | A | C | A | B |
| CE 2 | A | C | C | D | A | B |
| CE 3 | A | C | D | D | A | B |
| CE 4 | C | B | B | D | A | B |
| CE 5 | C | A | A | A | A | B |
| CE 6 | A | A | A | D | A | B |
| CE 7 | C | A | A | A | A | B |
| CE 8 | C | A | A | A | A | B |
| CE 9 | C | A | A | A | A | B |
| CE 10 | C | A | A | A | A | B |
| CE 11 | C | A | A | A | A | B |
| CE 12 | C | A | A | A | A | B |
| CE 13 | D | A | A | A | A | B |
| CE 14 | D | C | C | B | A | B |
| CE 15 | D | A | A | A | A | B |
| CE 16 | A | C | C | C | A | B |
| CE 17 | C | C | C | B | A | B |
| CE 18 | D | A | A | A | A | B |
| CE 19 | D | A | A | A | A | B |
| CE 20 | A | C | C | C | A | B |
| CE 21 | A | A | A | A | B | B |
| CE 22 | D | A | A | B | A | B |

Table 3 revealed that in the lithographic printing plates and lithographic printing plate precursors (Examples 1 to 30) obtained using the lithographic printing plate supports each having an anodized aluminum film in which micropores having specified average diameters and average depths were formed, the press life, deinking ability after suspended printing, on-press developability, deinking ability in continued printing, scratch resistance and resistance to dotted scumming were excellent.

The large-diameter portions making up the micropores obtained in Examples 1 to 6, 8 to 22 and 24 to 30 had such an inversely tapered shape (conical shape) that the diameter increases from the surface of the anodized film toward the aluminum plate side (i.e., the bottom average diameter was larger than the surface layer average diameter). The large-diameter portions making up the micropores obtained in Examples 7 and 23 had a substantially straight tubular shape.

It was confirmed from the comparison between Examples 1 and 2 that an average depth of the large-diameter portions of 85 to 105 nm led to further excellent effects.

It was confirmed from the comparison between Examples 1 and 5 that an average diameter of the large-diameter portions of 11 to 13 nm led to further excellent effects.

On the other hand, the results revealed that Comparative Examples 1 to 22 which did not satisfy the relation between the average diameter and the average depth in the invention were less effective than Examples 1 to 30.

In particular, the results revealed that Comparative Examples 9 to 12 corresponding to Examples 1, 2, 3 and 16 of JP 2011-245844 A were poorer in press life than Examples 1 to 30 described above.

The lithographic printing plate supports obtained in Examples 13 to 15 and 26 to 30 were evaluated for edge burn as described below.

The results of edge burn evaluation in Examples 13 to 15 and 26 to 30 were "A" and thus good.

(Edge Burn Evaluation)

In the edge burn evaluation, oxygen intensity in a width direction of the support including opposite edges was measured in EPMA, a portion having a higher oxygen intensity by at least 10% than that at the center portion was defined as an edge burn portion, and the length of the edge burn portion in the width direction was calculated.

The edge burn with a length in the width direction of less than 5 mm was rated "A" and that with a length of at least 5 mm was rated "B."

Example B

Manufacture of Lithographic Printing Plate Precursor (Part 2)

Each of the lithographic printing plate supports (Examples 1 to 3, 5 and 16 and Comparative Examples 1 to 3 and 15) manufactured as described above was subjected to post-treatment with a solution containing 4 g/l of polyvinylphosphonic acid at 40° C. for 10 seconds, rinsed with demineralized water at 20° C. for 2 seconds and dried.

Then, an image recording layer-forming coating liquid was applied onto the thus formed substrate by bar coating and dried in an oven at 50° C. for 60 seconds to form an image recording layer having a coating weight after drying of 0.91 g/m$^2$.

<Image Recording Layer-Forming Coating Liquid>

SAN (styrene/acrylonitrile copolymer (molar ratio 50/50)) 0.70 g

Infrared absorber (2) [of the structure below] 0.10 g

PVA 205 (available from Kuraray Co., Ltd.) 0.10 g

Aqueous solution containing 20 wt % of Megaface F-177 (available from Dainippon Ink & Chemicals, Inc.; fluorosurfactant) 0.05 g The structure of the infrared absorber (2) is shown below.

[Chemical Formula 5]

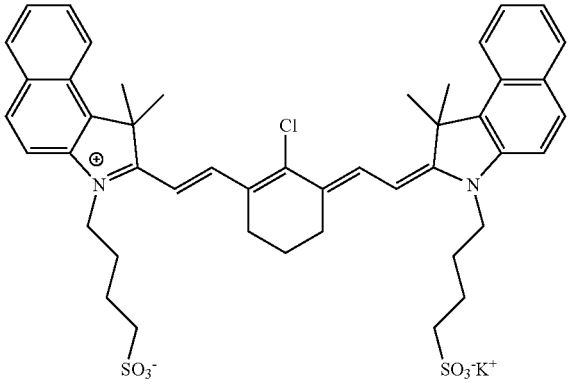

The evaluations described above were conducted for the resulting lithographic printing plate precursors. The results are all shown in Table 4. Examples and Comparative Examples using the lithographic printing plate supports manufactured in Examples 1 to 3, 5 and 16 and Comparative Examples 1 to 3 and 15 are set forth as EX 1B to EX 3B, EX 5B and EX 16B and CE 1B to CE 3B and CE 15B in Table 4 below, respectively.

TABLE 4

| | Press life | Deinking ability after suspended printing | deinking ability in continued printing | On-press develop-ability | Scratch resis-tance | Micro-dot |
|---|---|---|---|---|---|---|
| EX 1B | A | A | A | A | A | B |
| EX 2B | B | A | A | A | A | B |
| EX 3B | A | B | B | B | A | B |
| EX 5B | A | B | B | B | A | B |
| EX 16B | A | A | A | A | A | A |
| CE 1B | D | A | A | D | A | B |
| CE 2B | A | C | C | D | A | B |
| CE 3B | A | C | D | D | A | B |
| CE 15B | D | A | A | B | A | B |

It was confirmed that also in Examples using the image recording layer composed of different ingredients, the press life, deinking ability after suspended printing, on-press developability, deinking ability in continued printing, scratch resistance and resistance to dotted scumming were excellent.

What is claimed is:

1. A lithographic printing plate support, comprising an aluminum plate and an anodized film of aluminum which is formed on the aluminum plate and has micropores extending therein from a surface of the anodized film opposite from the aluminum plate in a depth direction of the anodized film, wherein each of the micropores has a large-diameter portion which extends from the surface of the anodized film to an average depth (depth A) of 75 to 120 nm and a small-diameter portion which communicates with a bottom of the large-diameter portion and extends to an average depth of 900 to 2,000 nm from a level of communication with the large-diameter portion, wherein an average diameter of the large-diameter portion at the surface of the anodized film is at least 10 nm but less than 30 nm and a ratio of the depth A to the average diameter (depth A/average diameter) of the large-diameter portion is more than 4.0 but up to 12.0, and wherein an average diameter of the small-diameter portion at the level of communication is more than 0 but less than 10.0 nm.

2. The lithographic printing plate support according to claim 1, wherein the small-diameter portion includes a first small-diameter portion and a second small-diameter portion that are different in average depth from each other, wherein the first small-diameter portion is larger in average depth than the second small-diameter portion, and wherein the anodized film between a bottom of the first small-diameter portion and a surface of the aluminum plate has an average thickness of at least 17 nm and a minimum thickness of at least 15 nm.

3. The lithographic printing plate support according to claim 2, wherein a first small-diameter portion density is 550 to 700 pcs/$\mu m^2$.

4. The lithographic printing plate support according to claim 3, wherein a difference in average depth between the first small-diameter portion and the second small-diameter portion is 75 to 200 nm.

5. The lithographic printing plate support according to claim 3, wherein the large-diameter portion has a diameter gradually increasing from the surface of the anodized film toward the aluminum plate whereby an average diameter (bottom average diameter) of the large-diameter portion at the level of communication is larger than an average diameter (surface layer average diameter) of the large-diameter portion at the surface of the anodized film; the bottom average diameter is more than 10 nm but up to 60 nm; and a ratio of the depth A to the bottom average diameter (depth A/bottom average diameter) is at least 1.2 but less than 12.0.

6. The lithographic printing plate support according to claim 3, wherein a ratio of the average diameter of the large-diameter portion at the surface of the anodized film to the average diameter of the small-diameter portion at the level of communication (large-diameter portion average diameter/small-diameter portion average diameter) is more than 1.00 but up to 1.50.

7. The lithographic printing plate support according to claim 2, wherein a difference in average depth between the first small-diameter portion and the second small-diameter portion is 75 to 200 nm.

8. The lithographic printing plate support according to claim 7, wherein the large-diameter portion has a diameter gradually increasing from the surface of the anodized film toward the aluminum plate whereby an average diameter (bottom average diameter) of the large-diameter portion at the level of communication is larger than an average diameter (surface layer average diameter) of the large-diameter portion at the surface of the anodized film; the bottom average diameter is more than 10 nm but up to 60 nm; and a ratio of the depth A to the bottom average diameter (depth A/bottom average diameter) is at least 1.2 but less than 12.0.

9. The lithographic printing plate support according to claim 7, wherein a ratio of the average diameter of the large-diameter portion at the surface of the anodized film to the average diameter of the small-diameter portion at the level of communication (large-diameter portion average diameter/small-diameter portion average diameter) is more than 1.00 but up to 1.50.

10. The lithographic printing plate support according to claim 2, wherein the large-diameter portion has a diameter gradually increasing from the surface of the anodized film toward the aluminum plate whereby an average diameter (bottom average diameter) of the large-diameter portion at the level of communication is larger than an average diameter (surface layer average diameter) of the large-diameter portion at the surface of the anodized film; the bottom average diameter is more than 10 nm but up to 60 nm; and a ratio of the depth A to the bottom average diameter (depth A/bottom average diameter) is at least 1.2 but less than 12.0.

11. The lithographic printing plate support according to claim 2, wherein a ratio of the average diameter of the large-diameter portion at the surface of the anodized film to the average diameter of the small-diameter portion at the level of communication (large-diameter portion average diameter/small-diameter portion average diameter) is more than 1.00 but up to 1.50.

12. The lithographic printing plate support according to claim 1, wherein the large-diameter portion has a diameter gradually increasing from the surface of the anodized film toward the aluminum plate whereby an average diameter (bottom average diameter) of the large-diameter portion at the level of communication is larger than an average diameter (surface layer average diameter) of the large-diameter portion at the surface of the anodized film; the bottom average diameter is more than 10 nm but up to 60 nm; and a ratio of the depth A to the bottom average diameter (depth A/bottom average diameter) is at least 1.2 but less than 12.0.

13. The lithographic printing plate support according to claim 12, wherein a surface area increase rate of the large-diameter portion is expressed by Equation (A):

$$(\text{Surface area increase rate})=1+\text{Pore density}\times((\pi\times(\text{Surface layer average diameter}/2+\text{Bottom average diameter}/2)\times((\text{Bottom average diameter}/2-\text{Surface layer average diameter}/2)^2+\text{Depth } A^2)^{1/2}+\pi\times(\text{Bottom average diameter}/2)^2-\pi\times(\text{Surface layer average diameter}/2)^2))$$

and the surface area increase rate is 1.9 to 16.0.

14. The lithographic printing plate support according to claim 13, wherein a ratio of the average diameter of the large-diameter portion at the surface of the anodized film to the average diameter of the small-diameter portion at the level of communication (large-diameter portion average diameter/small-diameter portion average diameter) is more than 1.00 but up to 1.50.

15. The lithographic printing plate support according to claim 12, wherein a ratio of the average diameter of the large-diameter portion at the surface of the anodized film to the average diameter of the small-diameter portion at the level of communication (large-diameter portion average diameter/small-diameter portion average diameter) is more than 1.00 but up to 1.50.

16. The lithographic printing plate support according to claim 1, wherein a ratio of the average diameter of the large-diameter portion at the surface of the anodized film to the average diameter of the small-diameter portion at the level of communication (large-diameter portion average diameter/small-diameter portion average diameter) is more than 1.00 but up to 1.50.

17. A lithographic printing plate precursor, comprising: the lithographic printing plate support according to claim 1; and an image recording layer formed thereon.

18. A lithographic printing plate support manufacturing method of manufacturing the lithographic printing plate support according to claim 1, comprising:

a first anodizing treatment step for anodizing the aluminum plate; and a second anodizing treatment step for further anodizing the aluminum plate having the anodized film obtained in the first anodizing treatment step.

* * * * *